US008787783B2

(12) United States Patent
Fuse

(10) Patent No.: US 8,787,783 B2
(45) Date of Patent: Jul. 22, 2014

(54) IMAGE FORMING APPARATUS HAVING VOLTAGE CONTROL

(75) Inventor: Takahito Fuse, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 13/450,644

(22) Filed: Apr. 19, 2012

(65) Prior Publication Data

US 2012/0269534 A1 Oct. 25, 2012

(30) Foreign Application Priority Data

Apr. 22, 2011 (JP) ..... 2011-096577

(51) Int. Cl.
*G03G 15/02* (2006.01)

(52) U.S. Cl.
USPC ..... 399/50; 399/89

(58) Field of Classification Search
CPC ..... G03G 15/0216; G03G 15/0266; G03G 15/0283
USPC ..... 399/50, 89; 361/221, 225
See application file for complete search history.

(56) References Cited

U.S. PATENT DOCUMENTS 5,842,081 A * 11/1998 Kaname et al. ..... 399/50
2012/0201553 A1* 8/2012 Hano ..... 399/50

FOREIGN PATENT DOCUMENTS

JP 63-149699 A 6/1988
JP 8-272194 A 10/1996

* cited by examiner

*Primary Examiner* — Sophia S Chen
(74) *Attorney, Agent, or Firm* — Fitzpatrick, Cella, Harper & Scinto

(57) ABSTRACT

An image forming apparatus including a rotatable photosensitive member, a first charging member for electrically charging the photosensitive member at a first charging portion by applying thereto a first DC voltage, and a second charging member, provided downstream of the first charging portion with respect to a rotational direction of the photosensitive member, for electrically charging the photosensitive member charged by the first charging member, at a second charging portion by applying thereto an oscillating voltage in the form of a second DC voltage superposed with an AC voltage. In addition, a toner image forming portion, provided downstream of the second charging portion and upstream of the first charging portion, forms a toner image on a surface of the charged photosensitive member, a current detecting portion detects a DC current passing through the second charging member, and a controller controls a voltage value of the first DC voltage on the basis of the detected DC current when the first DC voltage is applied to the first charging member and the oscillating voltage is applied to the second charging member. The controller controls the voltage value of the first DC voltage so that an absolute value of the detected DC current is smaller than a predetermined value.

2 Claims, 20 Drawing Sheets

IMAGE FORMING APPARATUS HAVING VOLTAGE CONTROL

FIELD OF THE INVENTION AND RELATED ART

The present invention relates to an image forming apparatus of an electrophotographic type such as a copying machine or a laser beam printer.

The electrophotographic image forming apparatus employing a charging type in which a charging member is directly contacted to or brought near to a photosensitive drum and then a charging voltage is applied to the charging member (hereinafter referred to as a contact charging type) has been commercialized. Here, depending on a waveform of the voltage applied to the charging member, the contact charging type can be classified into a DC charging type and an AC charging type.

In the DC charging type, only a DC voltage is applied to the charging member. In order to electrically charge the member to a target potential in the DC charging type, a DC voltage (Vth+Vd) which is the sum of a discharge start voltage (Vth) and a voltage (Vd) corresponding to the target potential may be applied to the charging member. However, the discharge start voltage Vth varies depending on a resistance fluctuation of the charging member or a change in temperature and humidity and therefore it is difficult to charge the photosensitive drum to a described charge potential with high accuracy.

In the AC charging type, a charging bias in the form of a DC voltage biased with an AC voltage is applied. Compared with the DC charging type, in the AC charging type, charging uniformity of the member is high. In other words, a degree of non-uniformity of the photosensitive drum potential after the charging is small. Further, when the AC voltage having a peak-to-peak voltage which is not less than 2 times the discharge start voltage Vth is applied to the charging member, the charge potential of the photosensitive drum is substantially equal to the DC voltage applied to the charging member. On the other hand, in the AC charging type, the AC voltage is applied and therefore, compared with the DC charging type, a discharge current amount becomes large. When the discharge current amount becomes large, such a disadvantage that an electric discharge product causing image defect which is called image flow is generated in a large amount has been known.

On the other hand, an image forming apparatus with a large copy volume such as a high-speed copying machine has been commercialized. In the case where use of the contact charging type in such a high-speed image forming apparatus is taken into consideration, it would be considered that a plurality of charging members are contacted to a photosensitive drum to charge the photosensitive drum (e.g., JP-A Hei 8-272194).

In a constitution in which the photosensitive drum is charged by using the plurality of charging members, there are a plurality of application methods. Specifically, e.g., it would be considered that a constitution in which (DC voltage)+(AC voltage) are applied to all the charging members is employed. Further, it would be considered that a constitution in which only the DC voltage is applied to all the charging members is employed.

In the circumstances, the present inventor has found that a total amount of a generated electric discharge product is suppressed while charging a photosensitive drum to a target potential by applying the (DC voltage)+(AC voltage) to a downstream-most charging member of the plurality of charging members and by applying only the DC voltage to an upstream charging member.

However, according to further study by the present inventor, it has been turned out that in the case where the downstream-most charging member is contaminated with a toner or the like, sufficient charging uniformity cannot be obtained depending on the DC voltage even when the DC voltage is biased with the AC voltage.

SUMMARY OF THE INVENTION

A principal object of the present invention is to provide an image forming apparatus having solved the above problem.

According to an aspect of the present invention, there is provided an image forming apparatus comprising: a rotatable image bearing member; a developing device for developing with a toner an electrostatic image formed on the image bearing member; a first charging member for electrically charging the image bearing member in contact with the image bearing member; a second charging member, provided downstream of the first charging member and upstream of the developing device with respect to a rotational direction of the image bearing member, for electrically charging the image bearing member in contact with the image bearing member; a first power source for applying a DC voltage to the first charging member; a second power source for applying an oscillating voltage, in the form of a DC voltage biased with an AC voltage, to the second charging member; a detecting device for detecting a DC current passing through the second charging member; and a controller for controlling, when the oscillating voltage is applied to the second charging member while the DC voltage is applied to the first charging member, the DC voltage applied to the first charging member so that the DC current detected by the detecting device falls within a predetermined range including zero.

These and other objects, features and advantages of the present invention will become more apparent upon a consideration of the following description of the preferred embodiments of the present invention taken in conjunction with the accompanying drawings.

Figure 4:
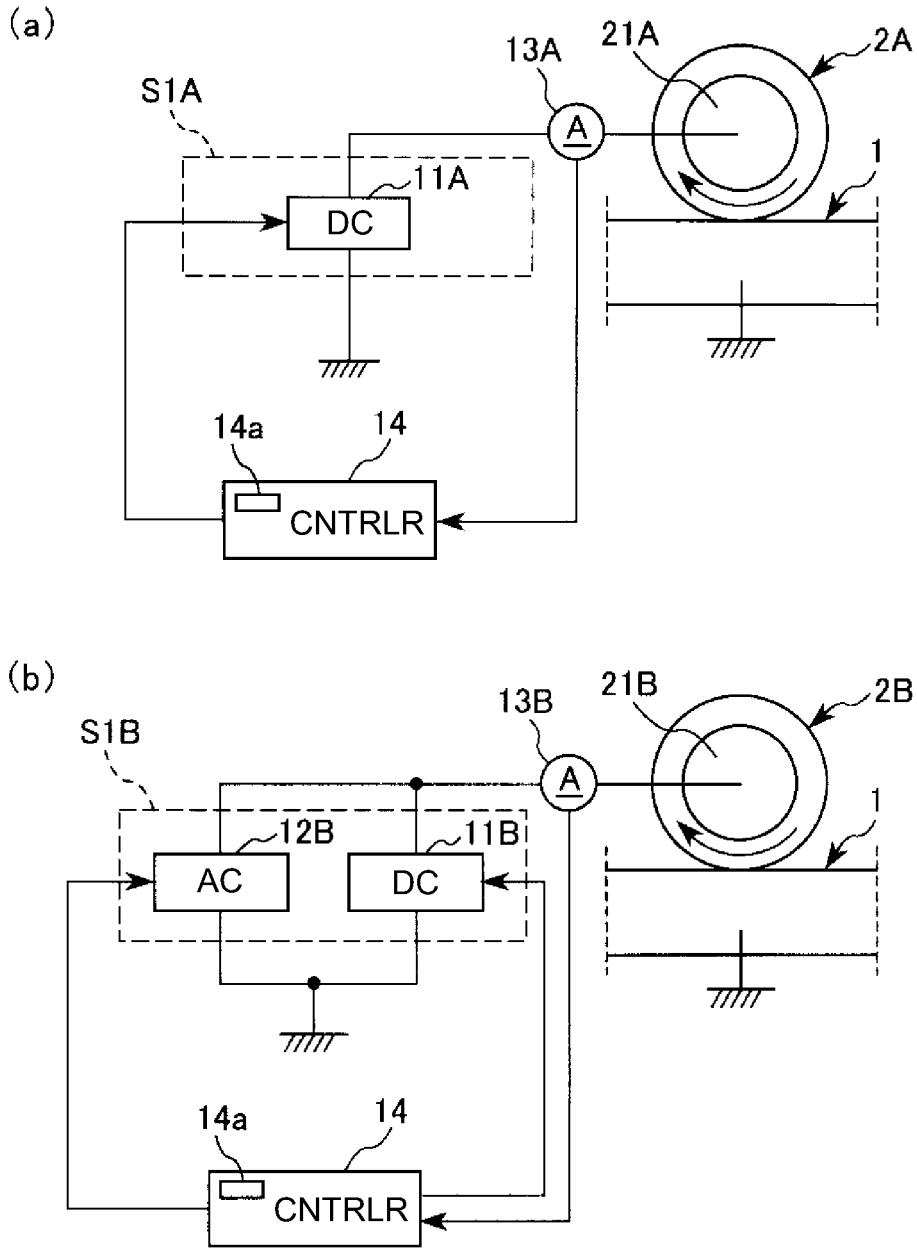

Parts (a) and (b) of FIG. 4 are block diagrams of charge voltage applying systems for the image and second charging rollers, respectively, of the image forming apparatus in Embodiment 1.

Figure 5:
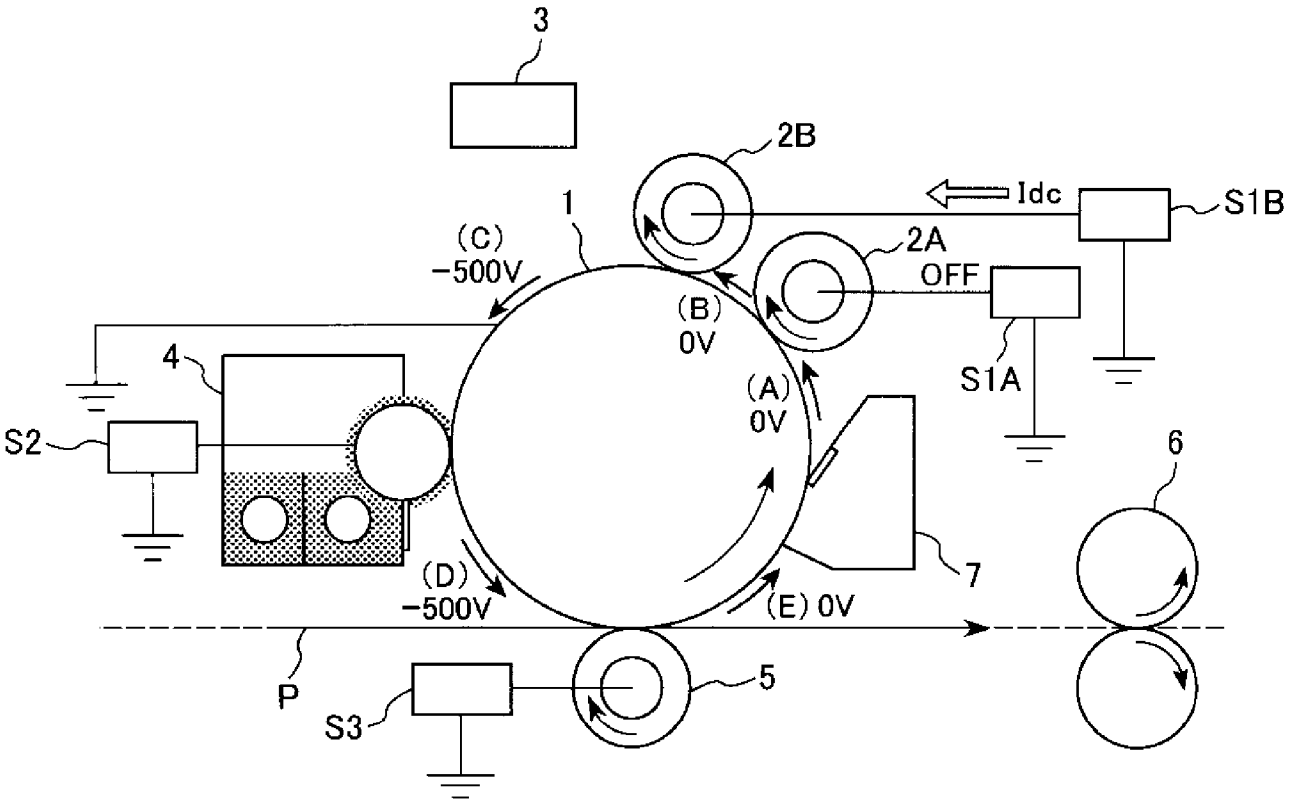

FIG. 5 is a schematic view showing surface potentials of a photosensitive drum at respective positions during target value setting control in the image forming apparatus in Embodiment 1.

Figure 6:
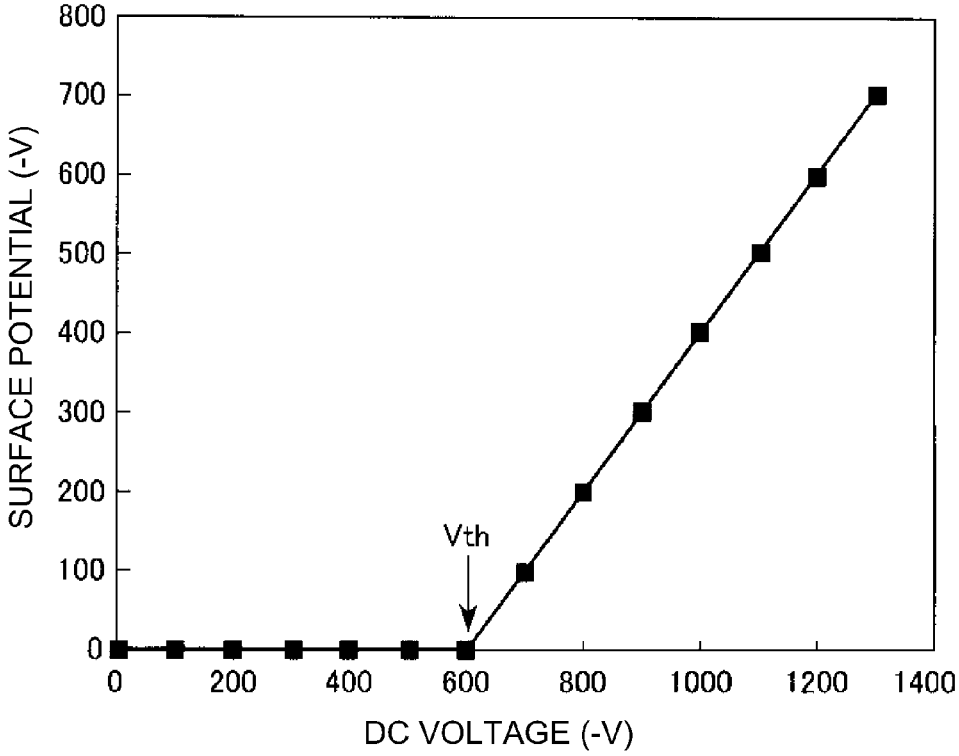

FIG. 6 is a graph showing a relationship between a charging DC bias applied to the charging roller and the surface potential of the photosensitive drum.

Figure 7:
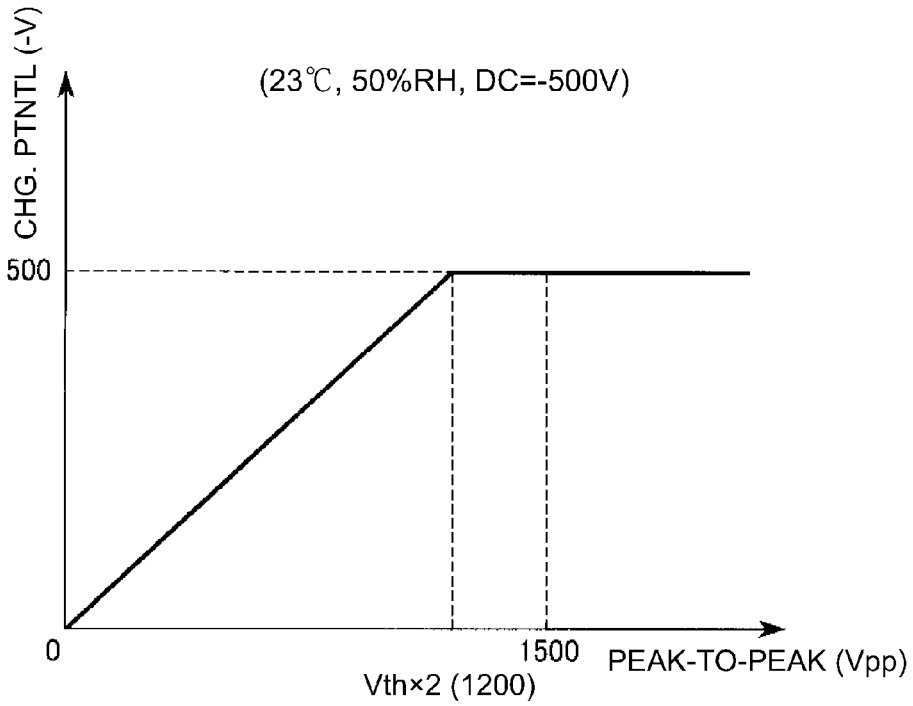

FIG. 7 is a graph showing a relationship between a peak-to-peak voltage of a charging AC bias applied to the charging roller and the surface potential of the photosensitive drum.

Figure 8:
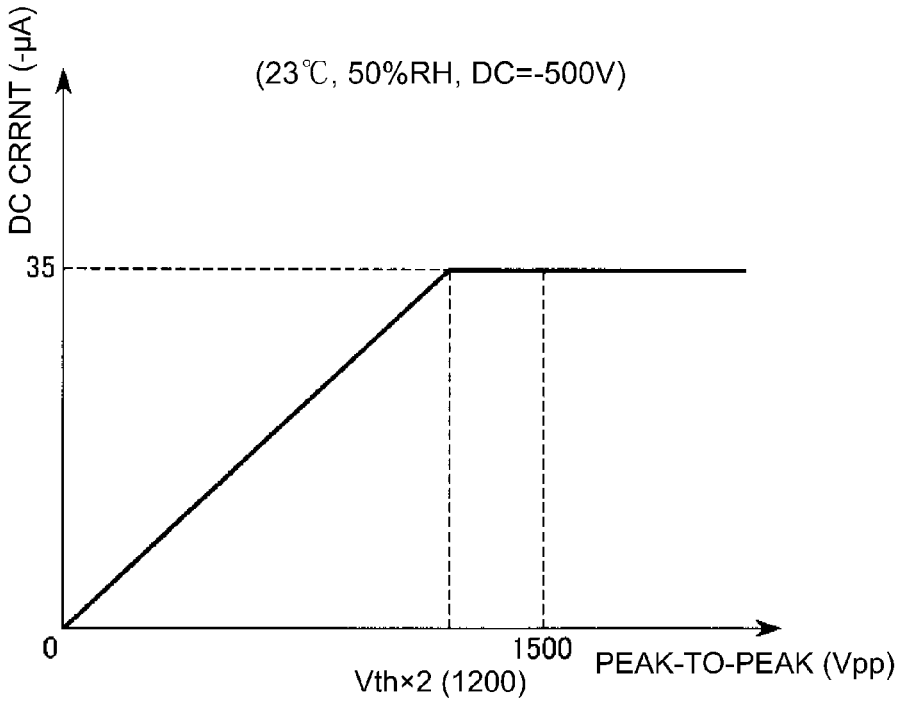

FIG. 8 is a graph showing a relationship between a peak-to-peak voltage of the charging AC bias applied to the charging roller and a DC current value.

Figure 9:
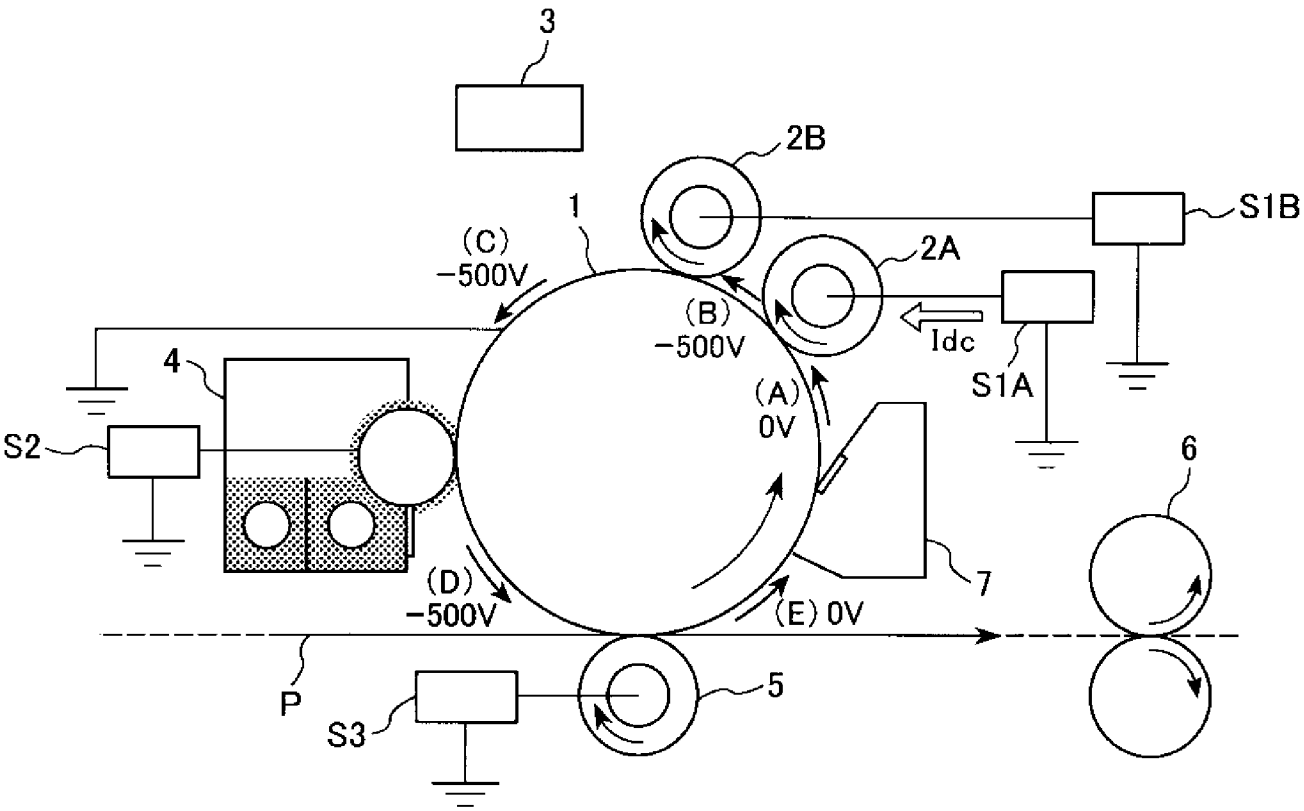

FIG. 9 is a schematic view showing surface potentials of the photosensitive drum at respective positions during image formation in the image forming apparatus in Embodiment 1.

Figure 10:
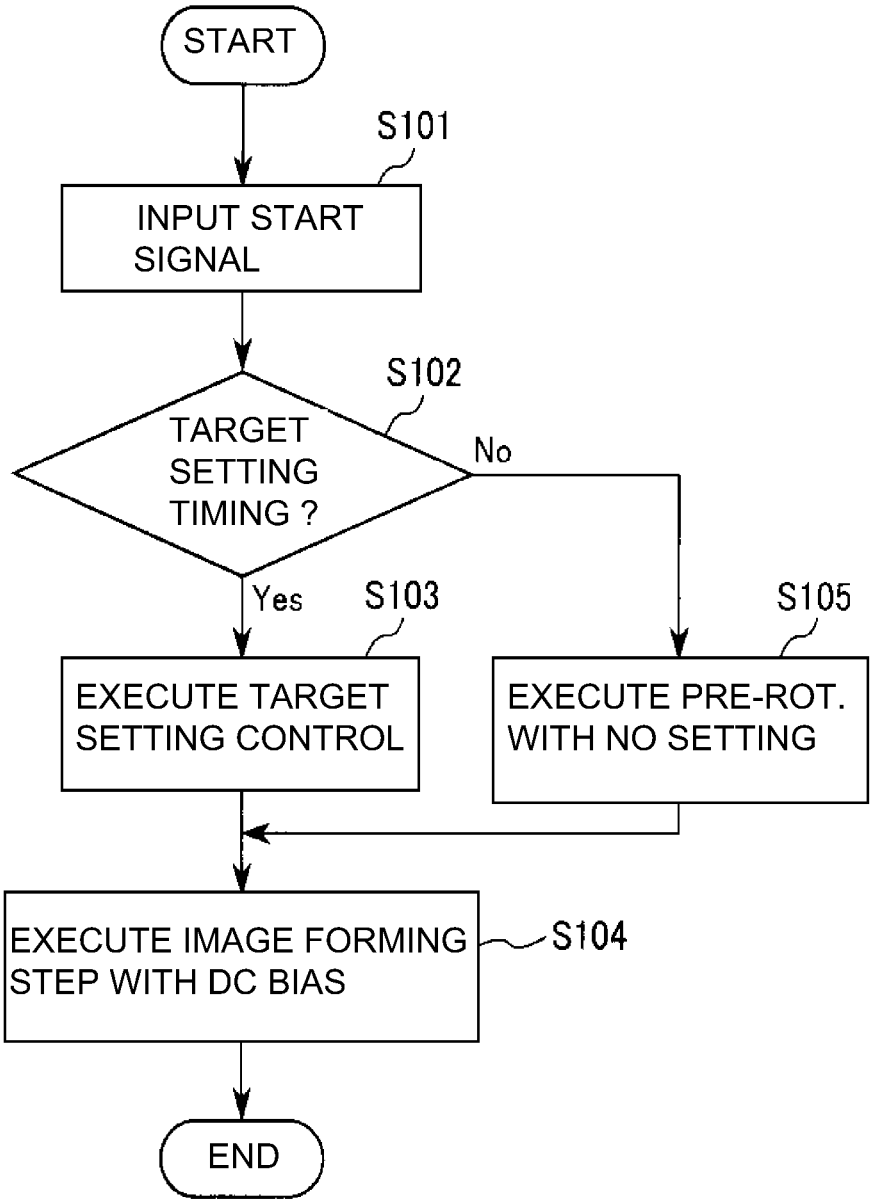

FIG. 10 is a flow chart of execution control of the target value setting control in the image forming apparatus in Embodiment 1.

Figure 11:
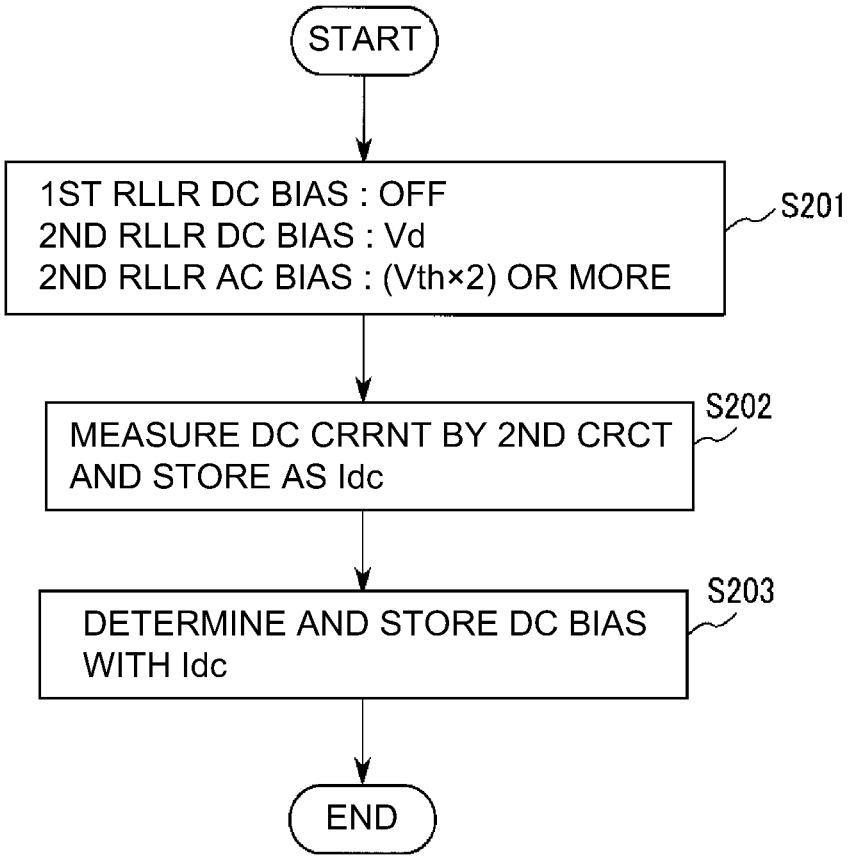

FIG. 11 is a flow chart of the target value setting control in the image forming apparatus in Embodiment 1.

Figure 12:
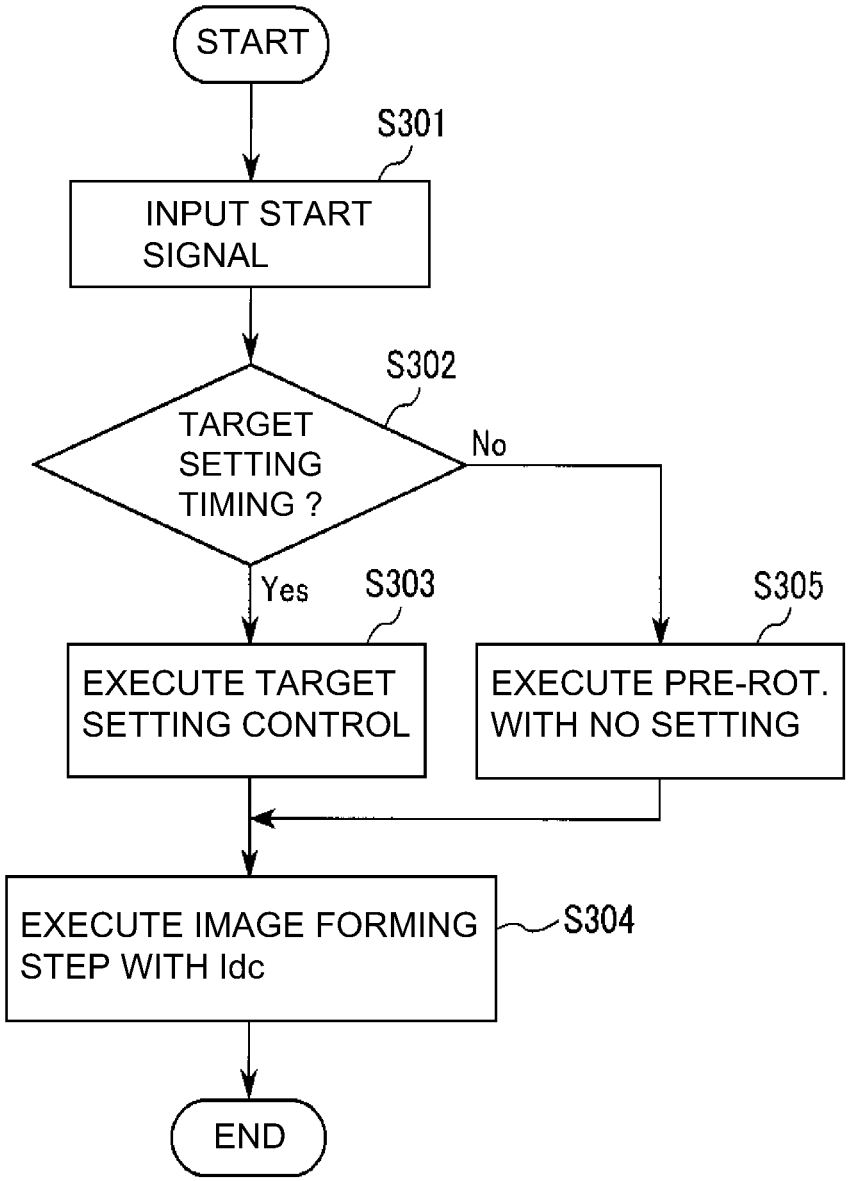

FIG. 12 is a flow chart of execution control of target value setting control in an image forming apparatus in Embodiment 2.

Figure 13:
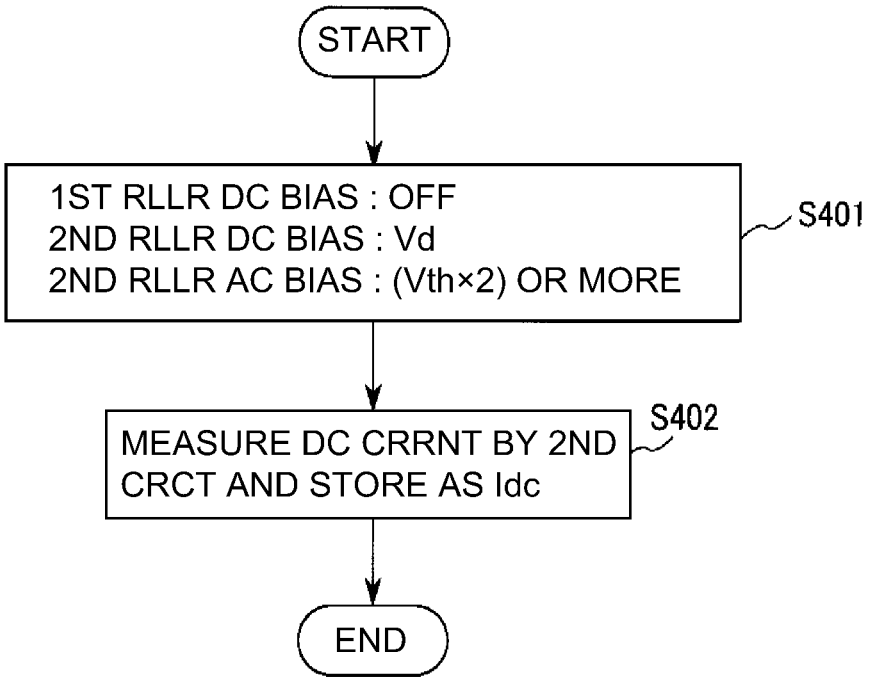

FIG. 13 is a flow chart of the target value setting control in the image forming apparatus in Embodiment 2.

Figure 14:
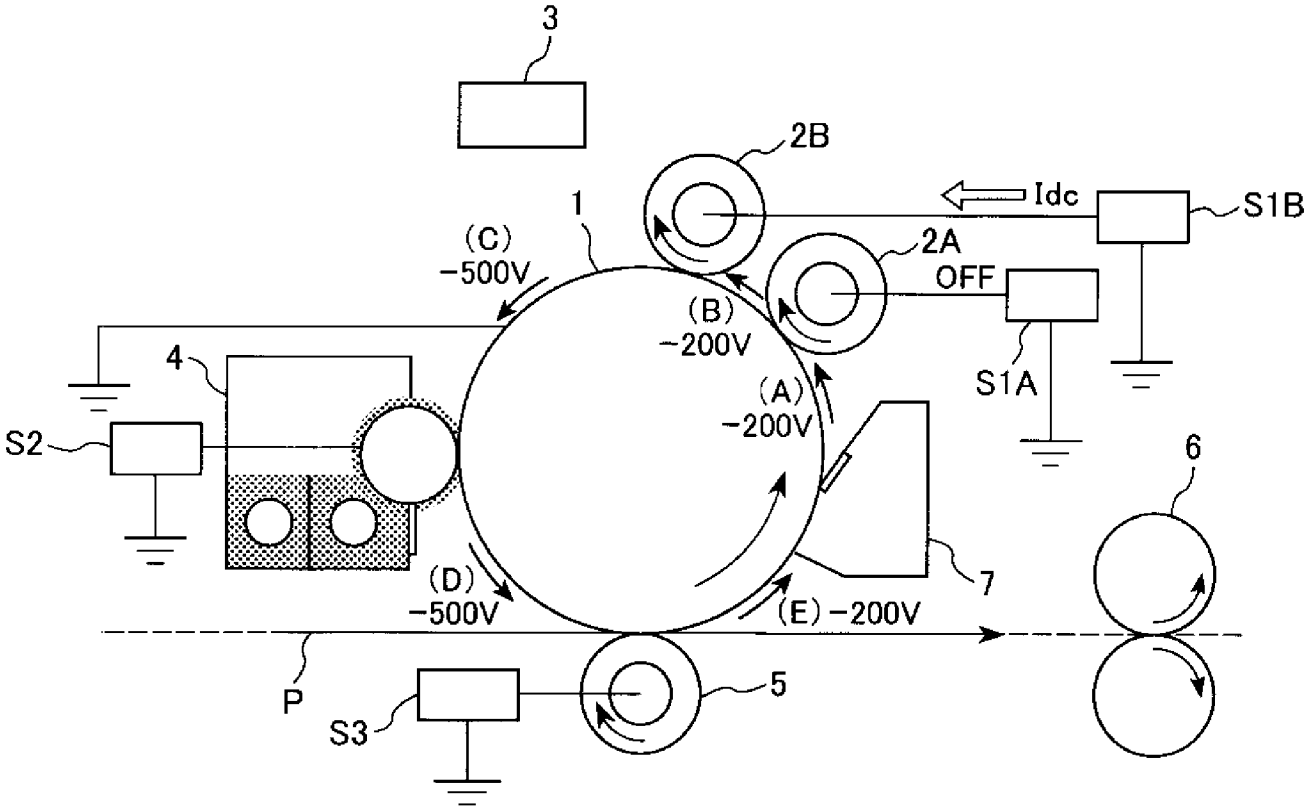

FIG. 14 is a schematic view showing surface potentials of a photosensitive drum at respective positions during target value setting control in an image forming apparatus in Embodiment 3.

Figure 15:
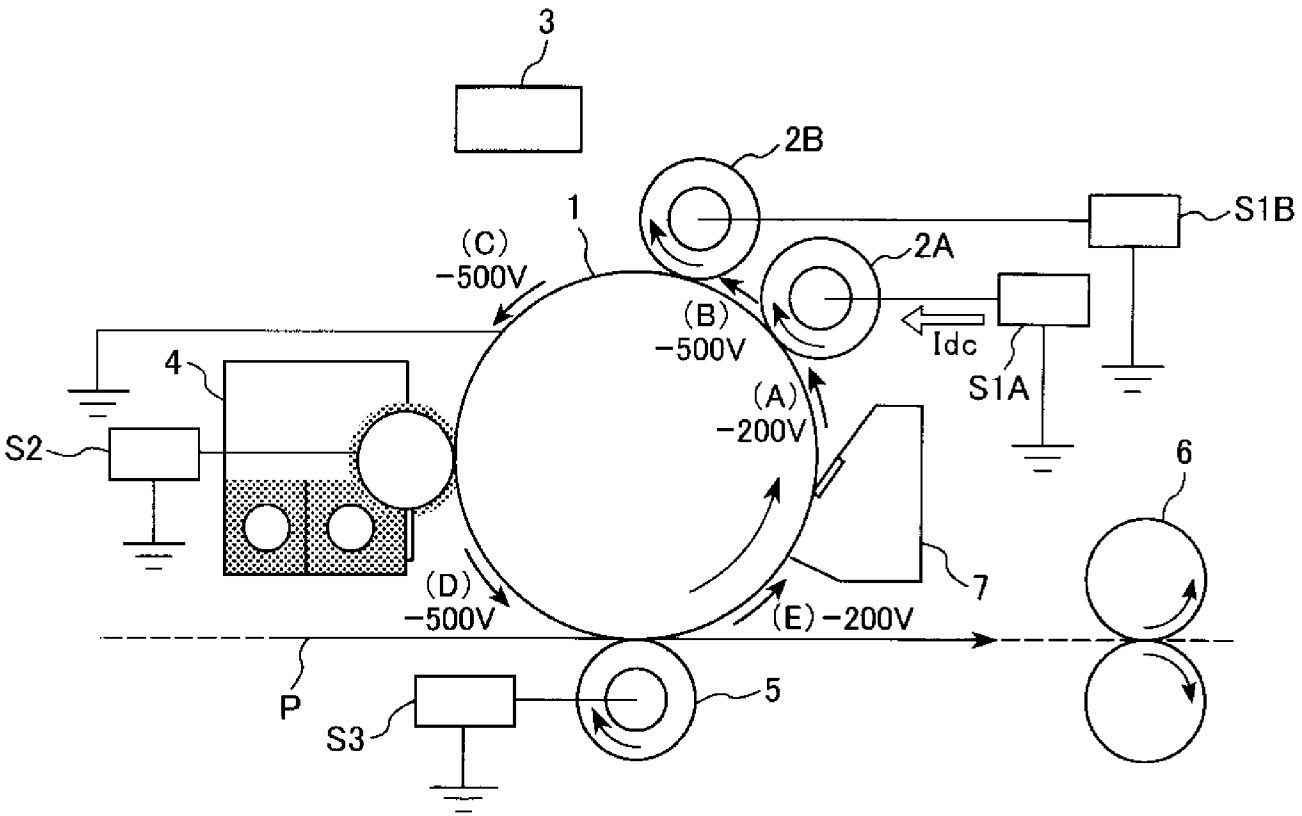

FIG. 15 is a schematic view showing surface potentials of the photosensitive drum at respective positions during image formation in the image forming apparatus in Embodiment 3.

Figure 16:
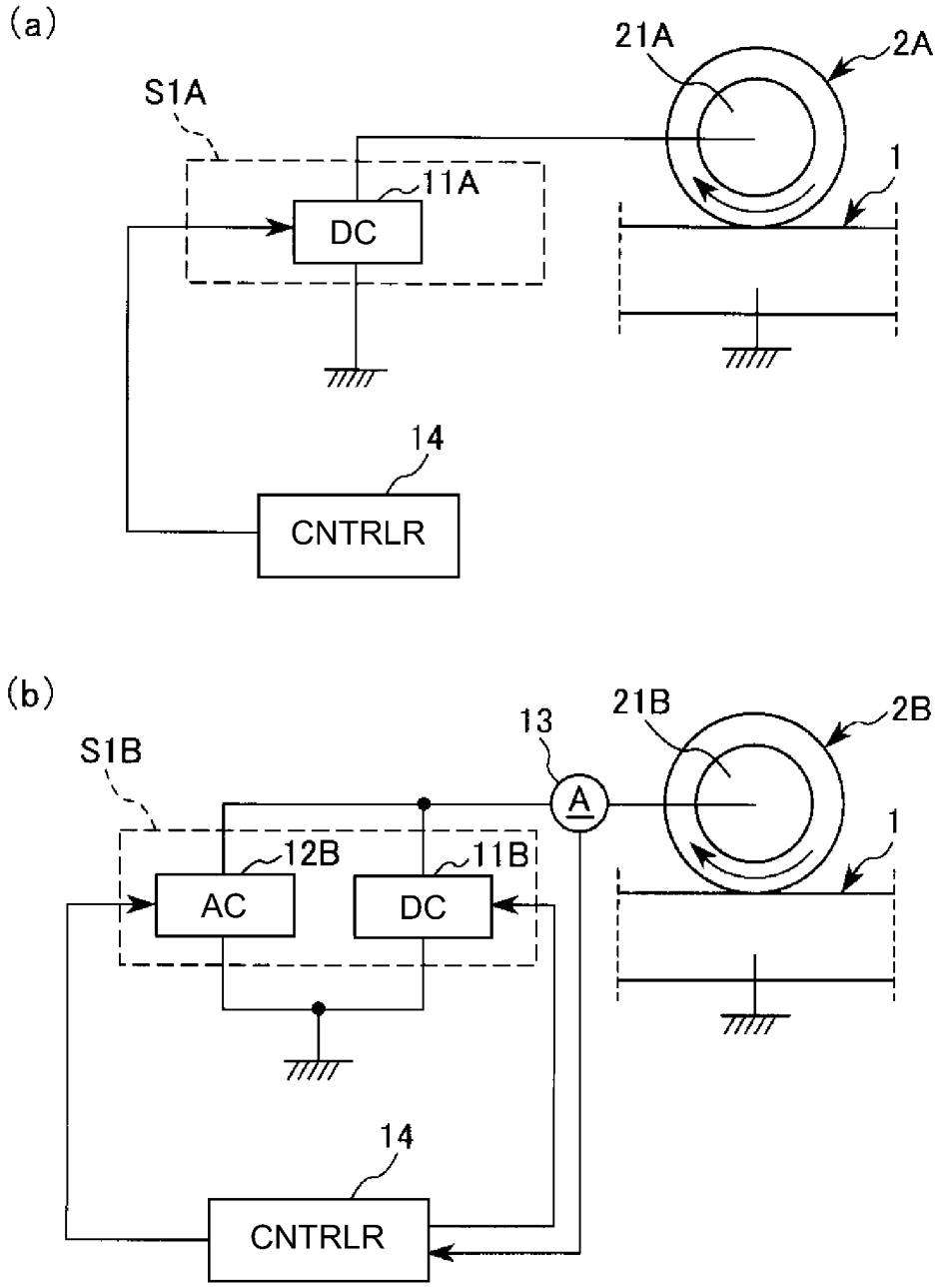

Parts (a) and (b) of FIG. 16 are block diagrams of charge voltage applying systems for first and second charging rollers, respectively, of an image forming apparatus in Embodiment 4.

Figure 17:
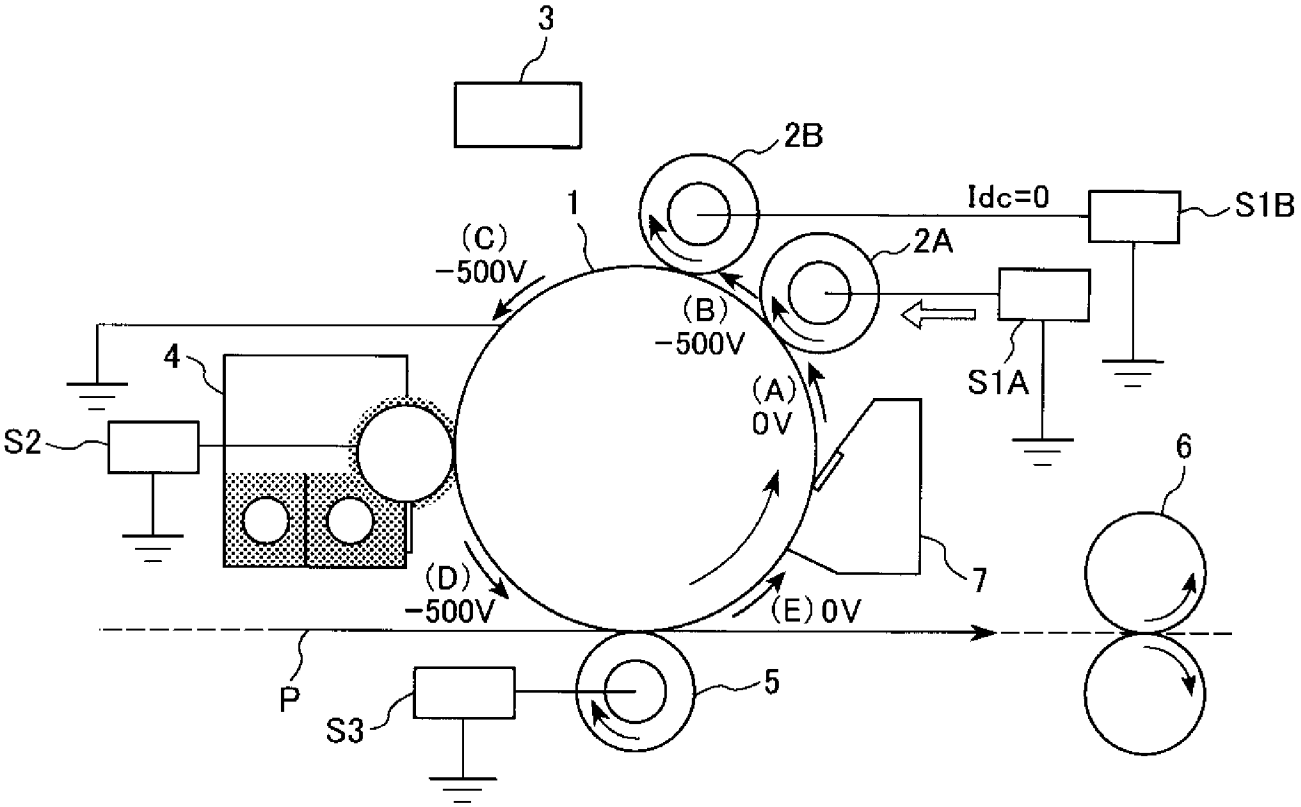

FIG. 17 is a schematic view showing surface potentials of a photosensitive drum at respective positions during charging DC bias control in the image forming apparatus in Embodiment 4.

Figure 18:
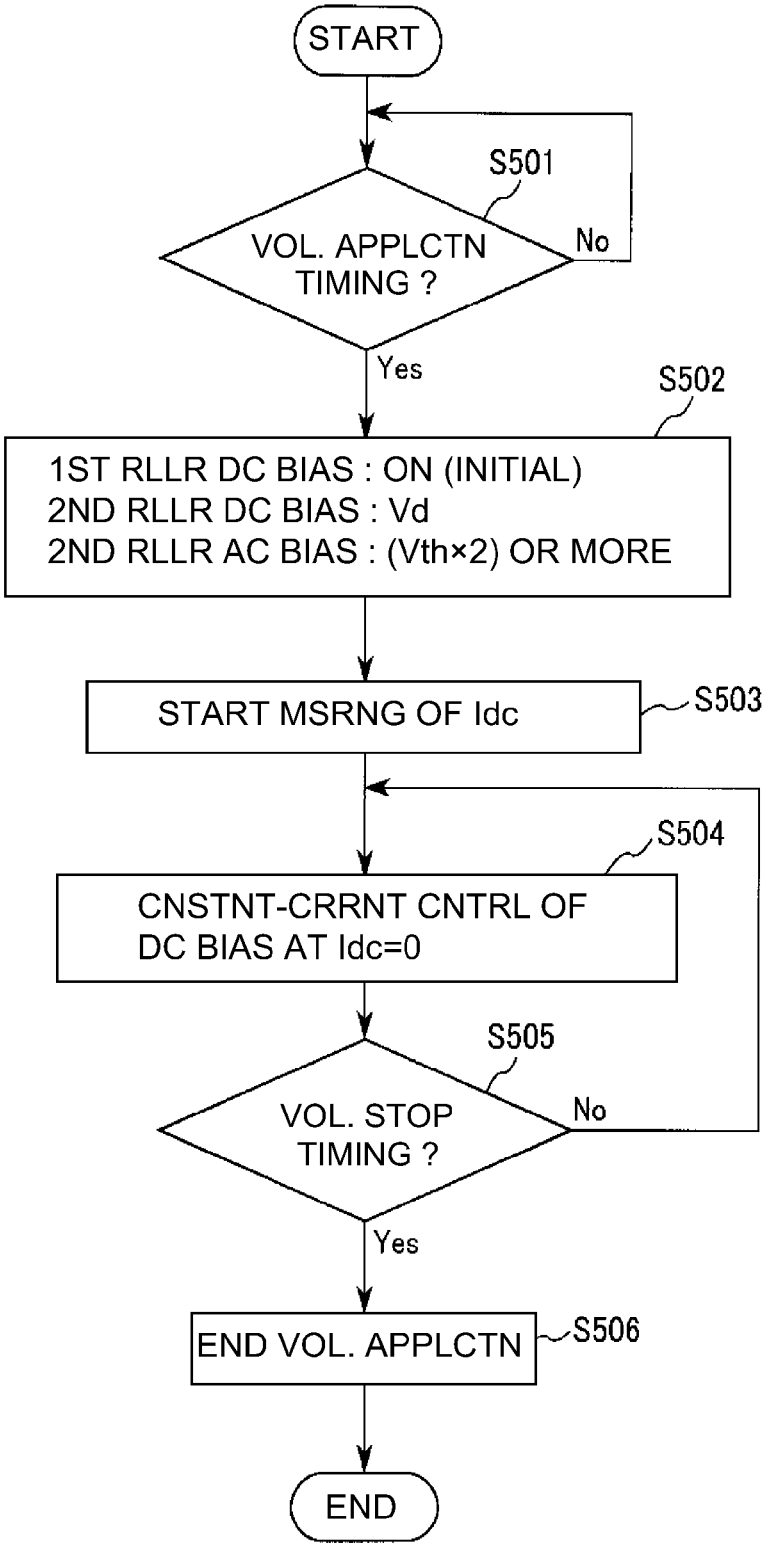

FIG. 18 is a flow chart of the charging DC bias control in the image forming apparatus in Embodiment 4.

Figure 19:
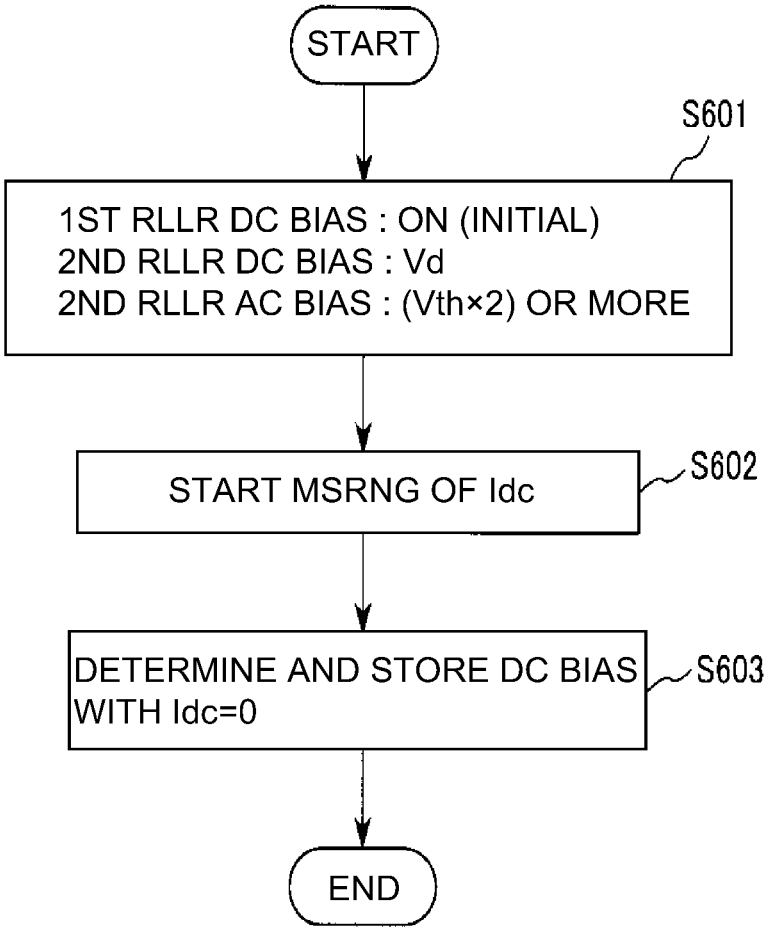

FIG. 19 is a flow chart of charging DC bias control in an image forming apparatus in Embodiment 5.

Figure 20:
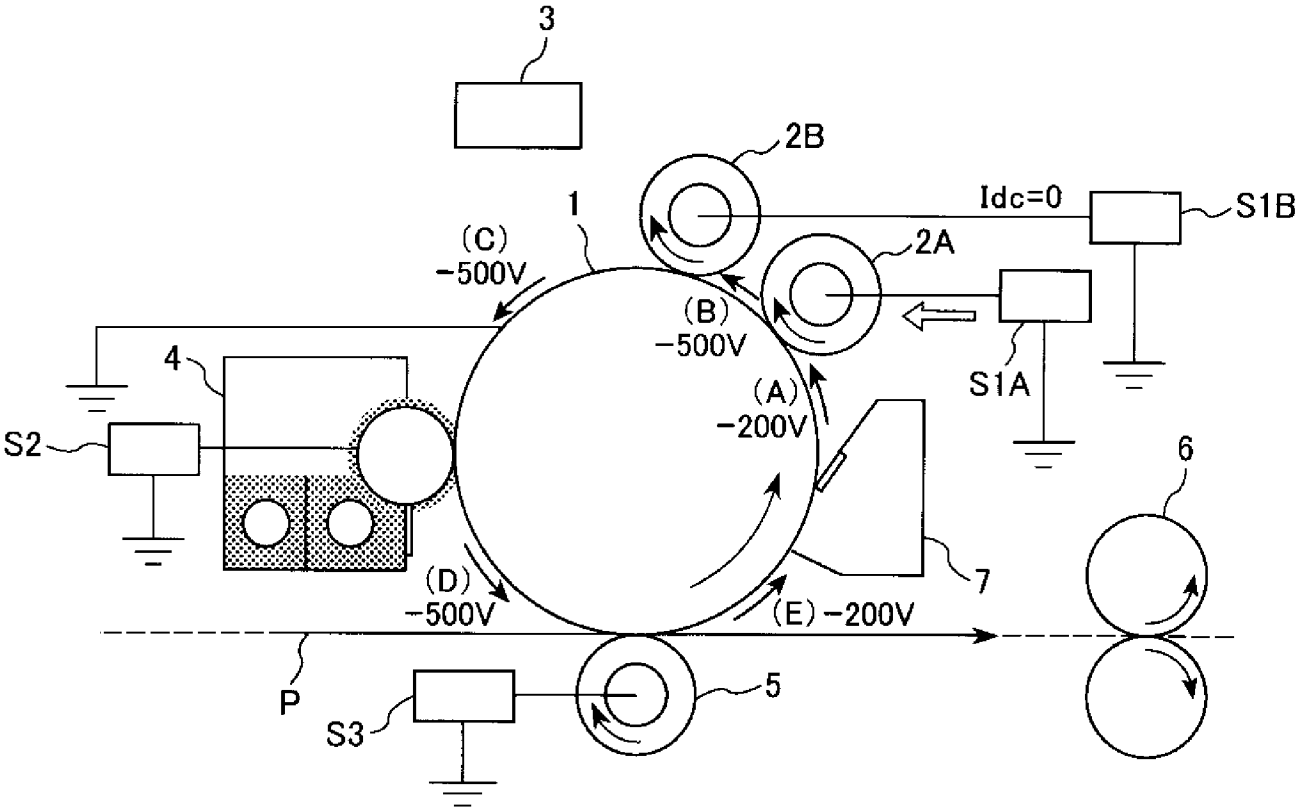

FIG. 20 is a schematic view showing surface potentials of a photosensitive drum at respective positions during charging DC bias control in an image forming apparatus in Embodiment 6.

Figure 21:
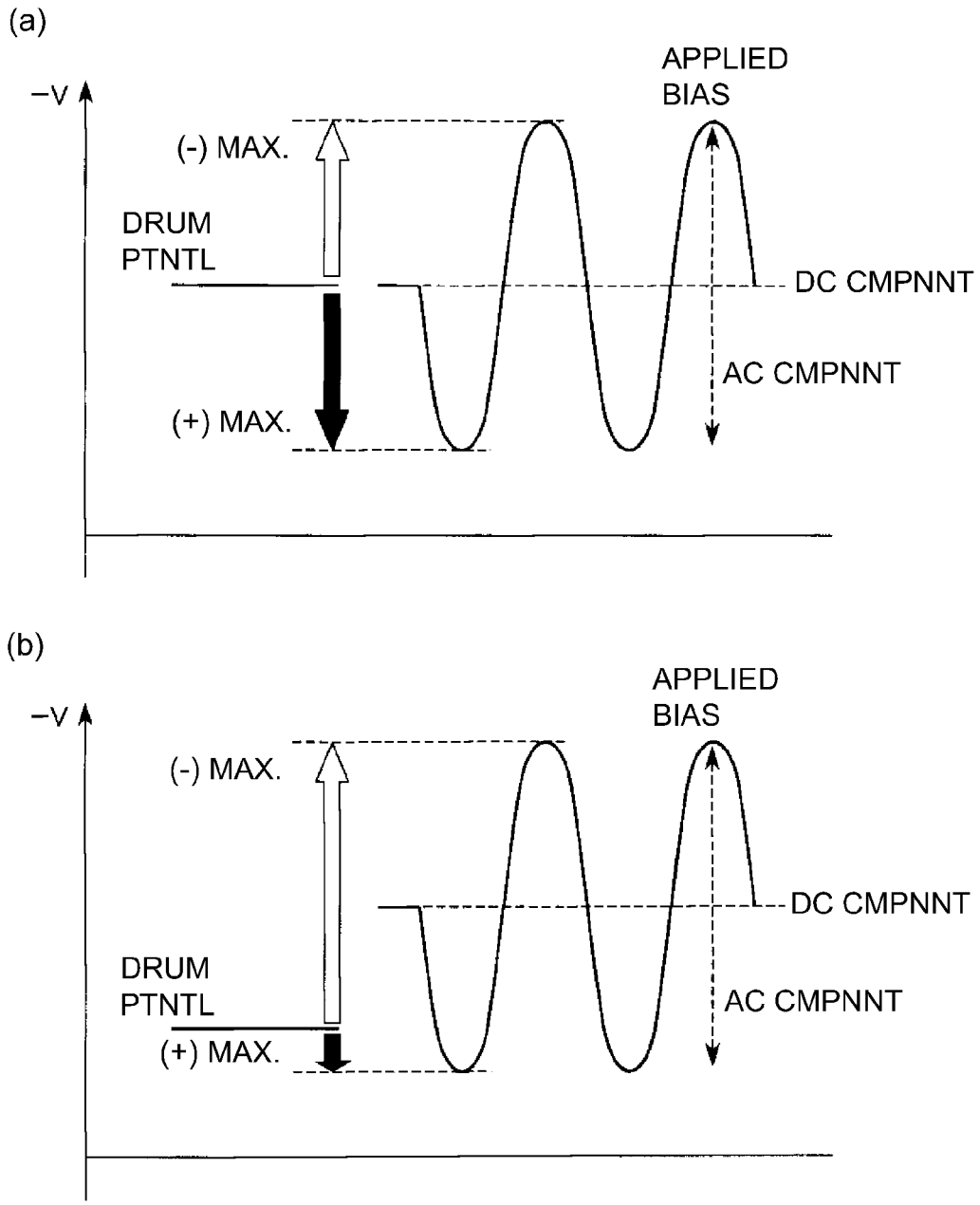

Parts (a) and (b) of FIG. 21 are illustrations for explaining a mechanism of an occurrence of a sandy image.

DESCRIPTION OF THE PREFERRED EMBODIMENTS

Hereinbelow, the image forming apparatus according to the present invention will be described with reference to the drawings.

Embodiment 1

1. Bias Constitution and Operation of Image Forming Apparatus

Figure 1:
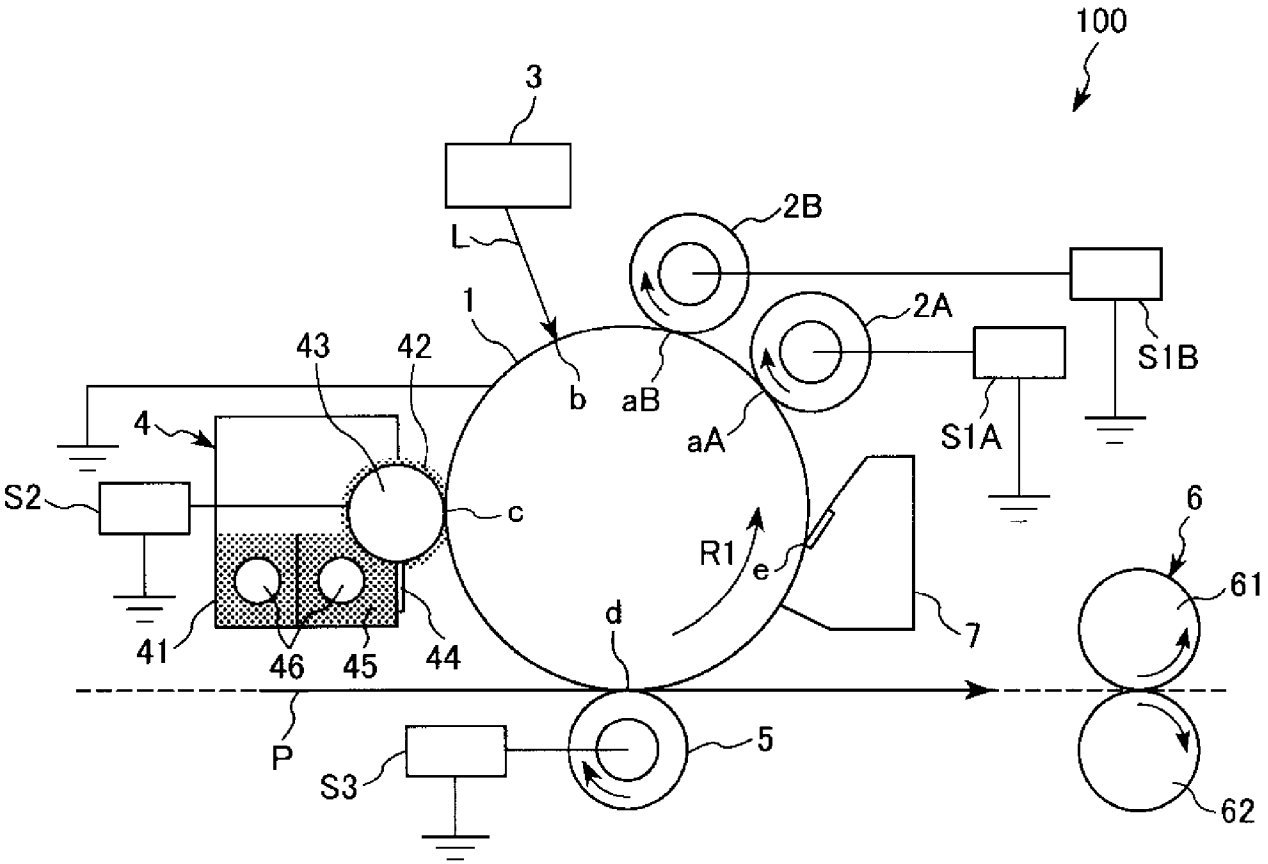
FIG. 1 is a schematic sectional view of an image forming apparatus in Embodiment 1.

FIG. 1 is a schematic sectional view of an image forming apparatus according to Embodiment 1 of the present invention. In this embodiment, the image forming apparatus 100 is a laser beam printer of an electrophotographic type which employs a contact charging type.

The image forming apparatus 100 includes a drum-type electrophotographic photosensitive member as an image bearing member, i.e., a photosensitive drum 1.

The photosensitive drum 1 is rotationally driven in an arrow R1 (counterclockwise) direction in the figure. Around the photosensitive drum 1, the following means are provided in the indicated order along a rotational direction of the photosensitive drum 1. The means are a first charging roller (first charging member) 2A and a second charging roller (second charging member) 2B which are a roller-type charging member as a charging means, an exposure device (laser scanner) 3 as an exposure means, a developing device 4 as a developing means, a transfer roller 5 which is a roller-type transfer member as a transfer means, and a cleaning device 7 as a cleaning means.

The photosensitive drum 1 includes, on an electroconductive drum substrate, a layer of organic photoconductor (OPC) having negative chargeability.

Further, in this embodiment, the photosensitive drum 1 has an outer diameter of 30 mm and is rotationally driven about its center shaft at a process speed (peripheral speed) of 130 mm/sec in the direction indicated by an arrow R1 (counterclockwise direction).

The photosensitive drum 1 is constituted by coating a photocharge generating layer, and a charge transporting layer in this order on the surface of an aluminium-made cylinder (electroconductive drum substrate).

The first and second charging rollers 2A and 2B are a contact charging means for uniformly charging the photosensitive drum surface. The first charging roller 2A is provided upstream of the second charging roller 2B with respect to a surface movement direction of the photosensitive drum 1, and the second charging roller 2B is provided downstream of the first charging roller 2A with respect to the surface movement direction of the photosensitive drum 1. Each of the first and second charging rollers 2A and 2B charges the surface of the photosensitive drum 1 to predetermined polarity and potential by using a discharge phenomenon generated in a minute gap between itself and the photosensitive drum 1.

Figure 2:
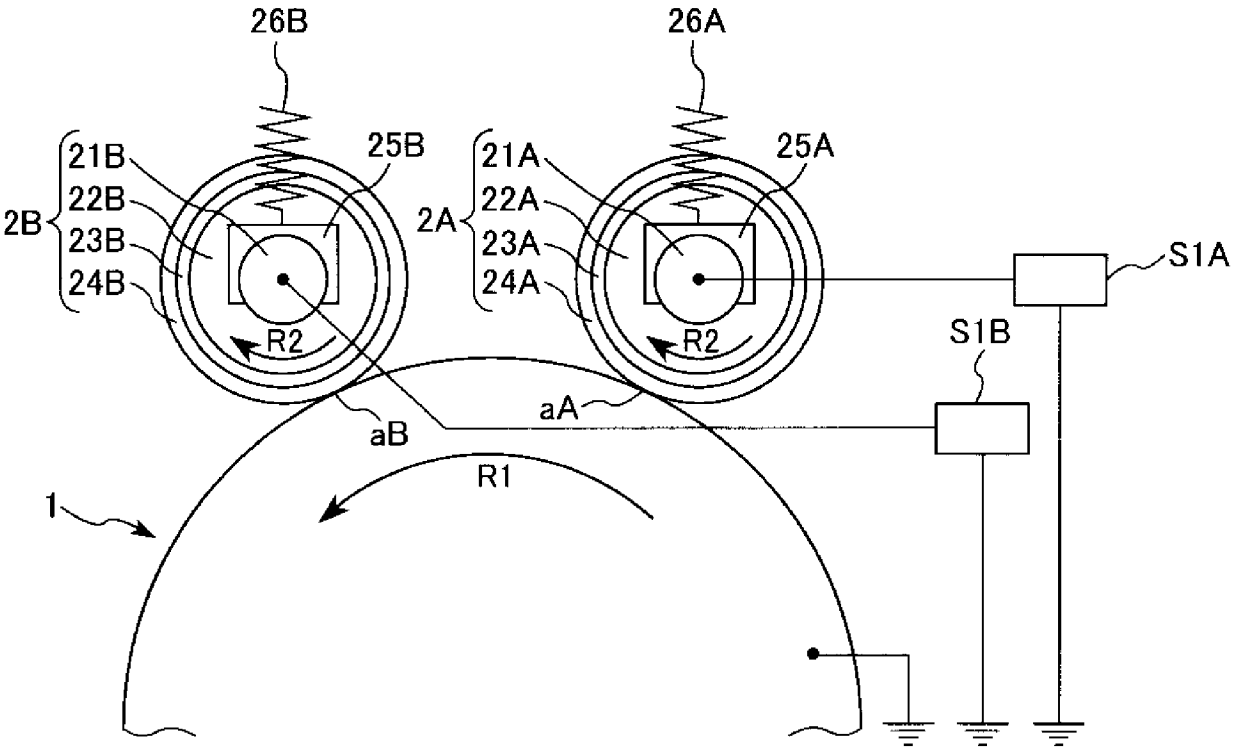
FIG. 2 is a sectional view showing first and second charging rollers of the image forming apparatus in Embodiment 1.

The constitutions of the first charging roller 2A and the second charging roller 2B will be further described by taking the first charging roller 2A as an example. In this embodiment, the first charging roller 2A and the second charging roller 2B which have substantially the same dimension and material were used. The second charging roller 2B has the substantially same constitution unless otherwise specified. In FIG. 2, elements (members) common to the first and second charging rollers 2A and 2B are represented by adding suffixes A and B, respectively, to reference numerals, so that the resultant reference symbols represents associated elements of the first and second charging rollers 2A and 2B.

As shown in FIG. 2, the first charging roller 2A is rotatably held (supported) by a bearing member 25A at each of end portions of a core metal (supporting member) 21A and at the same time is urged toward the photosensitive drum 1 by an urging spring 26A. As a result, the first charging roller 2A is press-contacted to the photosensitive drum 1 with a predetermined urging force. Further, the charging roller 2A is rotated in a direction indicated in the figure by an arrow R2 (clockwise) by the rotation of the photosensitive drum 1. A press-contact portion between the photosensitive drum 1 and the charging roller 2A is a charging portion (charging nip) aA. In the minute gap (charging gap) formed between the surface of the first charging roller 2A and the surface of the photosensitive drum 1 at each of an upstream side and a downstream side of the charging nip aA with respect to the surface movement direction of the photosensitive drum 1, electric discharge is carried out. A portion where the photosensitive drum 1 is charged by this electric discharge is a charging portion.

The first charging roller 2A can be prepared as an electroconductive elastic roller having the following constitution. That is, the first charging roller 2A may include a core metal, an electroconductive elastic layer formed in a roller shape coaxially with the core metal at an outer peripheral surface of the core metal by dispersing electroconductive carbon black particles in SBR or the like, and a high-resistance coating layer, formed on an outer peripheral surface of the elastic layer, for preventing improper charging. Further, on the outer peripheral surface of the coating layer, a protective coating layer for preventing the charging roller from adhering to the photosensitive drum may be provided.

More specifically, in this embodiment, the first charging roller 2A is 320 mm in length with respect to its longitudinal direction (rotational axis direction) and 14 mm in diameter. Further, the first charging roller 2A has, around a core metal 21A, a three-layer structure consisting of a lower layer 22A, an intermediary layer 23A, and a surface layer 24A which are successively laminated in this order. The core metal 21A is a stainless steel rod with a diameter of 6 mm. The lower layer 22A is formed of carbon-dispersed foam EPDM (ethylene-propylene-dien rubber) (specific gravity: 0.5 g/cm$^3$, volume resistivity: $10^2$–$10^9$ ohm·cm, layer thickness: about 3.5 mm). The intermediary layer 23A is formed of carbon-dispersed NBR (nitrile-butadiene rubber) rubber (volume resistivity: $10^2$–$10^5$ ohm·cm, layer thickness: about 500 μm). The surface layer 24A is formed of Toresin which is fluorine-containing resin in which tin oxide and carbon particles are dispersed (volume resistivity: $10^7$–$10^{10}$ ohm·cm, surface roughness (JIS ten-point average surface roughness Rz): 1.5 μm, layer thickness: about 5 μm).

Incidentally, in this embodiment, the first and second charging rollers 2A and 2B having the substantially same dimensions and material were used but the dimensions and material of the first and second charging rollers 2A and 2B may also be different from each other. Further, the constitution of the charging members is not limited to that described above in this embodiment.

To the core metals 21A and 21B of the first and second charging rollers 2A and 2B, charging voltages (charging biases) under predetermined conditions are applied from first and second charging power sources S1A and S1B, respectively, as charging voltage applying means.

In this embodiment, the first charging power source (first power source) S1A includes a DC power source and does not include an AC power source, and outputs a DC voltage to the first charging roller 2A. On the other hand, the second charging power source (second power source) S1B includes the DC power source and the AC power source and outputs an oscillating voltage, in the form of a DC voltage (DC component) biased with an AC voltage (AC component), to the second charging roller 2B.

In this embodiment, the surface of the photosensitive drum 1 is uniformly charged to −500 V by using the first and second charging rollers 2A and 2B. Specific charging voltage control will be described later.

The exposure device 3 is the exposure means as an information writing means for forming an electrostatic latent image on the charged surface of the photosensitive drum 1. In this embodiment, the exposure device 3 is a laser beam scanner using a semiconductor laser. An image signal is sent, to the image forming apparatus 100, from an unshown host processing device such as an image reading device connected with the image forming apparatus 100. The exposure device 3 outputs laser light L modulated correspondingly to the image signal and subjects the uniformly charged surface of the rotating photosensitive drum 1 to scanning exposure (image exposure) at an exposure portion (exposure position) b. As a result, the potential of the surface of the photosensitive drum 1 which has been irradiated with the laser light L is lowered in absolute value, so that the electrostatic latent image is formed on the rotating photosensitive drum 1 surface correspondingly to image information.

The developing device 4 is the developing means for reversely developing the electrostatic latent image into a toner image (developer image) by supplying the toner to the electrostatic latent image on the photosensitive drum 1. In this embodiment, the developing device 4 employs a two-component contact developing type in which the development is effected while bringing a magnetic brush of a two-component developer into contact with the photosensitive drum 1.

The developing device 4 includes a developing container 41 and a non-magnetic developing sleeve 42 as a developer carrying member. A part of an outer peripheral surface of the developing sleeve 42 is exposed to an outside of the developing container 41, and the developing sleeve 42 is disposed rotatably in the developing container 41.

In the developing sleeve 42, a magnet roller 43 is provided so as to be non-rotatably fixed to the developing container 41. A developing blade 44 is provided opposed to the developing sleeve 42. The developing container 41 accommodates a two-component developer 45 and at a bottom side in the developing container 41, developer stirring members 45 are provided. Further, a toner for replenishment is accommodated in an unshown toner hopper.

The two-component developer 45 in the developing container 41 is principally a mixture of a toner (non-magnetic toner particles) and a carrier (magnetic carrier particles) and is stirred by the developer stirring members 46. In this embodiment, a volume resistivity of the carrier is about $10^{13}$ Ω·cm, and the particle size (volume-average particle size) is about 40 μm. Here, the particle size is measured by using a laser diffraction type particle size distribution measuring device ("HEROS", mfd. by JEOL Ltd.) in a manner that the particle size range of 0.5-350 μm is logarithmically divided into 32 decades and the median diameter of 50% in volume is used as the volume-average particle size. In this embodiment, the toner is triboelectrically charged to the negative polarity by friction with the carrier.

The developing sleeve 42 is disposed opposed to the photosensitive drum 1 while keeping the closest distance (S-D gap) from the photosensitive drum 1 at 350 μm. This opposing portion between the photosensitive drum 1 and the developing sleeve 42 is a developing portion c. The developing sleeve 42 is rotationally driven at the developing portion c so that its surface movement direction is opposite to the surface movement direction of the photosensitive drum 1. By a magnetic force of the magnet roller 43 in the developing sleeve 42, a part of the two-component developer 45 in the developing container 41 is adsorbed and held as a magnetic brush layer on the outer peripheral surface of the developing sleeve 42. This magnetic brush layer is rotationally conveyed with the rotation of the developing sleeve 42 and its thickness is adjusted to provide a predetermined thin layer, which is contacted to the surface of the photosensitive drum 1 to appropriately rub against the surface of the photosensitive drum 1 at the developing portion c.

To the developing sleeve 42, a predetermined developing voltage (developing bias) is applied from a developing power source S2 as a developing voltage applying means. In this embodiment, the predetermined bias voltage applied to the developing sleeve 4*b* is an oscillating voltage in the form of a DC voltage ($V_{DC}$) biased with an AC voltage ($V_{AC}$). More specifically, the predetermined developing voltage is the oscillating voltage in the form of the DC voltage (developing DC bias) of −350 V biased with the AC voltage (developing AC bias) (frequency: 8.0 kHz, peak-to-peak voltage: 1.8 KV, rectangular wave).

The toner in the two-component developer 45 which is coated as the thin layer on the surface of the rotating developing sleeve 42 and which is conveyed to the developing portion c is selectively deposited, correspondingly to the electrostatic latent image, on the surface of the photosensitive drum 1 by an electric field generated by the developing voltage, so that the electrostatic latent image on the photosensitive drum 1 is developed as a toner image. In this embodiment, the electrostatic latent image is reversely developed by depositing the toner charged to the same polarity as the charge polarity (negative in this embodiment) of the photosensitive drum 1 at an exposed portion (light portion) on the surface of the photosensitive drum 1 which is exposed to light after being uniformly charged. In this case, a charge amount of the toner transferred on the photosensitive drum 1 is about −25 μC/g in an environment of a temperature of 23° C. and an absolute water content of 10.6 g/m$^3$.

The thin layer of the two-component developer 45, on the developing sleeve, having passed through the developing portion c is returned to a developer containing portion in the developing container 41 by further rotation of the developing sleeve 42.

In order to keep a toner content (proportion of the weight of the toner to a total weight of the toner and the carrier of the two-component developer) of the two-component developer 45 in the developing container 41 at a level within a substantially constant range, the toner for replenishment is replenished from a toner hopper (not shown) into the developing container 41. That is, e.g., the toner content of the two-component developer 45 in the developing container 41 is detected by, e.g., an optical toner content sensor. Then, depending on its detection information, drive of the unshown toner hopper is controlled, so that the toner for replenishment in the toner hopper is replenished into the developing container 41. The toner replenished into the two-component developer 45 is stirred by the developer stirring members 46.

The transfer roller 5 is press-contacted to the photosensitive drum 1 with a predetermined urging force. A press-contact portion (nip) between the transfer roller 5 and the photosensitive drum 1 is a transfer portion d. To this transfer portion d, a transfer material P such as a recording sheet is fed and conveyed from a transfer material feeding mechanism portion (not shown) with predetermined control timing. The transfer material P fed to the transfer portion d is nipped and conveyed between the photosensitive drum 1 and the transfer roller 5 which are rotated. During the nip-conveyance, to the transfer roller 5, a transfer bias of a (positive) polarity opposite from the (negative) polarity as a normal charge polarity of the toner is applied from a transfer power source S3 as a transfer voltage applying means. More specifically, in this embodiment, as the transfer voltage, a DC voltage of +600 V is applied. As a result, the toner image on the photosensitive drum 1 surface is electrostatically transferred onto the surface of the transfer material P which is nip-conveyed through the transfer portion d.

The transfer material P which passes through the transfer portion and is subjected to the transfer of the toner image thereon is separated from the surface of the photosensitive drum 1 and is conveyed to a fixing device 6 as a fixing means. In this embodiment, the fixing device 6 is a heating roller fixing device including a fixing roller 61 provided with a heat source and a pressing roller 62 press-contacted to the fixing roller 61. Further, the fixing device 6 heats and presses the transfer material P at the press-contact portion (nip) between the fixing roller 61 and the pressing roller 62, so that the toner image is fixed on the transfer material P. The transfer material P subjected to the fixing is outputted as an image-formed product (print or copy) from the image forming apparatus 100.

Further, a transfer residual toner somewhat remaining on the surface of the photosensitive drum 1 after the toner image transfer onto the transfer material P at the transfer portion d is removed from the surface of the photosensitive drum 1 by a cleaning device 7 at a cleaning portion e, thus being collected.

Figure 3:
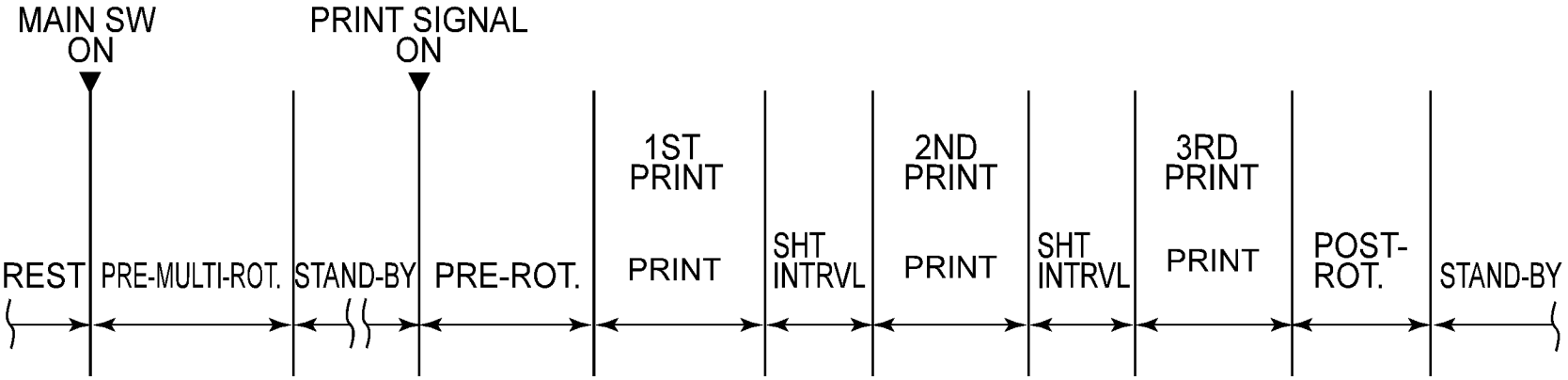
FIG. 3 is an operation sequence diagram of the image forming apparatus in Embodiment 1.

FIG. 3 is an operation sequence diagram of the above-described image forming apparatus 100.

(1) Pre-Multi-Rotation Step (Initial Rotation Operation)

In an actuation operation period (warm-up period) during actuation of the image forming apparatus 100, the photosensitive drum 1 is rotationally driven by turning a (main) power switch on and preparatory operations, of predetermined process devices (equipment), such as warm-up of the fixing device 6 to a predetermined temperature are executed.

(2) Pre-Rotation Step (Preparatory Rotation Operation for Printing)

In a preparatory rotation operation period, before image formation, from image formation start signal input until an image forming (printing) step operation is actually performed, this pre-rotation step is executed in succession to the pre-multi-rotation step when the image formation start signal is inputted during the pre-multi-rotation step. When the image formation start signal is not inputted, the drive of the main motor is once interrupted, after the pre-multi-rotation step is completed, to stop the rotational drive of the photosensitive drum, so that the image forming apparatus 100 is kept in a stand-by (waiting) state until the image formation start signal is inputted. When the image formation start signal is inputted, the pre-rotation step is executed.

In this embodiment, in this pre-rotation step, an operation/determination program for a value of the charge voltage (particularly a value of the DC current passing through the image charging roller 2A and a corresponding charging DC bias) in the charging step in the image forming process is executed. This will be specifically described later.

(3) Image Forming Step (Printing Step)

When the pre-rotation step is completed, an image forming process with respect to the photosensitive drum 1 is carried out and then the toner image formed on the photosensitive drum 1 surface is transferred onto the transfer material P and fixed by the fixing device 6, so that the image-formed product is outputted.

In the case of a continuous image forming mode, the above-described image forming process is repeatedly performed correspondingly to the number of sheets subjected to image formation.

(4) Sheet Interval Step

This step corresponds to a non-sheet-passing state period, of the transfer material P at the transfer portion d in the continuous image forming mode, from after a trailing end of a transfer material P passes the transfer portion d until a leading end of a subsequent transfer material reaches the transfer portion d.

(5) Post-Rotation Step

In a period in this step, a predetermined post-process operation is performed in a manner such that the main motor drive is continued for a time, even after the image forming step for a final transfer material P is completed, to rotationally drive the photosensitive drum 1.

(6) Stand-by

When the predetermined post-rotation step is completed, the main motor drive is stopped to stop the rotational drive of the photosensitive drum 1 and then the image forming apparatus 100 is kept in a stand-by state until a subsequent image formation start signal is inputted.

In the case of image formation on only one sheet, after completion of the image formation, the image forming apparatus 100 is in a stand-by state after completion of the post-rotation step. In the stand-by state, when the image formation start signal is inputted, the image forming apparatus 100 goes to the pre-rotation step.

The period of the above-described (3) Image forming step corresponds to during image formation. Further, each of the period of the above-described (1) Pre-multi-rotation step, (2) Pre-rotation step, (4) Sheet interval, and (5) Post-rotation step corresponds to during non-image formation.

2. Control Embodiment

Parts (a) and (b) of FIG. 4 are block circuit diagrams of the charging voltage applying systems with respect to the first charging roller 2A and the second charging roller 2B, respectively.

As shown in (a) of FIG. 4, to the first charging roller 2A, the first charging power source S1A as the charging voltage applying means is connected. This first charging power source S1A includes a DC power source 11A. From the first charging power source S1A, the DC voltage (charging DC bias) is applied to the first charging roller 2A through the core metal 21A. As a result, the peripheral surface of the rotating photosensitive drum 1 is charged to the predetermined potential. Further, to the first charging power source S1A, a first DC current value measuring circuit (first measuring circuit) 13A as a DC current value detecting means (first detecting means) is connected. The first measuring circuit 13A detects the value of the DC current passing through the first charging roller 2A via the photosensitive drum 1 by outputting the DC voltage from the first charging power source S1A to the first charging roller 2A. From the first measuring circuit 13A to a control circuit 14 as a control means, information on the measured DC current value is inputted.

On the other hand, as shown in (b) of FIG. 4, to the second charging roller 2B, the second charging power source S1B as the charging voltage applying means is connected. This second charging power source S1B includes a DC power source 11B and an AC power source 12B. From the first charging power source S1B, a predetermined oscillating voltage in the form of the DC voltage (charging DC bias) biased with an AC voltage with a predetermined frequency (charging AC bias) is applied to the second charging roller 2B through the core metal 21B. As a result, the peripheral surface of the rotating photosensitive drum 1 is charged to the predetermined potential. Further, to the second charging power source S1B, a second DC current value measuring circuit (second measuring circuit) 13B as a DC current value detecting means (second detecting means) is connected. The second measuring circuit 13B detects the value of the DC current passing through the second charging roller 2B via the photosensitive drum 1 by outputting the oscillating voltage from the second charging power source S1B to the second charging roller 2B. From the second measuring circuit 13B to the control circuit 14 as a control means, information on the measured DC current value is inputted.

The control circuit 14 as the control means effects integrated control of the operation of the image forming apparatus 100. Particularly, in a relation to this embodiment, the control circuit 14 has the function of controlling the value of the DC voltage applied from the DC power source 11A of the first charging power source S1A to the first charging roller 2A. Further, the control circuit 14 has the function of controlling the value of the DC voltage applied from the DC power source 11B of the second charging power source S1B to the second charging roller 2B. Further, the control circuit 14 has the function of controlling the value of the peak-to-peak voltage of the AC voltage applied to or the value of the AC current passing through the second charging roller 2B form the AC power source 12B of the second charging power source S1B. Further, the control circuit 14 has the function of executing, on the basis of the DC current value information inputted from the first measuring circuit 13A and/or the second measuring circuit 13B, the operation/determination program of the charging DC bias applied to the first charging roller 2A and/or the second charging roller 2B in the charging step of the image forming process.

3. Occurrence of Sandy Image

As described above, when the peak-to-peak voltage of the AC component of the charge voltage is decreased in the AC charging type, image defect which is called a "sandy image" is liable to occur. This is attributable to a phenomenon that the AC discharge current passing between the charging roller and the photosensitive drum is decreased but the electric discharge is liable to become unstable and therefore excessive electric discharge (abnormal electric discharge) locally occurs. By the abnormal electric discharge, the photosensitive drum partly has an abnormal high potential and at that portion, the toner is not deposited and therefore a sandpaper-like image defect is caused when an image is outputted.

Parts (a) and (b) of FIG. 21 are schematic views for illustrating a mechanism when the sandy image occurs. Here, as a model, the image forming apparatus of the reverse development type in which the photosensitive drum is uniformly charged to the negative polarity by the charging roller and is subjected to the charge removal by the exposure device and at the charge-removed portion, the negatively charged toner is deposited is used.

Part (a) of FIG. 21 shows a relationship between the potentials in the AC charging type when the surface potential of the photosensitive drum before the charging and the charging DC bias potential are the same. This state is a state in which a maximum potential difference at the negative side is smallest and in which the abnormal electric discharge depending on the potential difference is not most readily caused to occur. Therefore, a degree of the occurrence of the sandy image resulting from the abnormal electric discharge is most reduced. That is, in the AC charging type, when the surface potential of the photosensitive drum before the charging and the charging DC bias are the same, the occurrence of the sandy image can be minimized even during the use of the AC charging type.

However, in general, as shown in (b) of FIG. 21, the relationship between the potentials in the AC charging type is such that an absolute value of the photosensitive drum surface potential before the charging is smaller than an absolute value of the charging DC bias. Incidentally, in (b) of FIG. 21, the charging AC bias is the same as that in the case of (a) of FIG. 21. In this case, the potential difference between the photosensitive drum surface potential before the charging in the AC charging type and a maximum of the voltage applied to the charging roller in the AC charging type is large, so that the state in which the abnormal electric discharge is liable to occur is formed. Therefore, when compared with the case of (a) of FIG. 21, the state in which the sandy image is liable to occur is formed.

4. Charge Voltage Control

Next, a control method of the charge voltage applied to the first and second charging rollers 2A and 2B will be described specifically. Incidentally, the control in this embodiment is effected in an environment of a temperature of 23° C. and a humidity (relative humidity) of 50% RH.

As described above, in the AC charging type, when the photosensitive drum surface potential before the charging and the charging DC bias potential are the same, the abnormal electric discharge is not most readily caused to occur, so that the degree of the occurrence of the sandy image is most reduced.

Therefore, in this embodiment, first, charge current target value setting control as described below is effected. That is, in the target value setting control in this embodiment, a value of a DC current, carried by the charging in the DC charging type, necessary to change the surface potential of the photosensitive drum 1 before the charging in the AC charging type to a target potential Vd (necessary to increase the absolute value of the photosensitive drum surface potential up to the target potential Vd) is obtained. Further, in this embodiment, particularly the following value is obtained from the above DC value in the target value setting control. That is, a value (target voltage value) of the charging DC bias, applied by the charging in the DC charging type, necessary to change the surface potential of the photosensitive drum 1 before the charging in the AC charging type to the target potential Vd (necessary to increase the absolute value of the photosensitive drum surface potential up to the target potential Vd) is obtained. This will be described below more specifically.

In this embodiment, various bias settings during the target value setting control are as follows. The charging DC bias applied to the first charging roller 2A is turned off. Further, to the second charging roller 2B, the charging DC bias of −500 V and the peak-to-peak voltage of 1500 V (1500 Vpp) of the charging AC bias are applied. The developing DC bias is −350 V. The transfer bias is +600 V. Further, these bias settings are kept constant and then the image forming apparatus 100 is operated without forming an image. In this case, operation settings of respective portions of the image forming apparatus, such as the various bias settings, are the same as those during the image formation except for the charging DC bias applied to the first charging roller 2A and the charging AC bias applied to the second charging roller 2B.

FIG. 5 is a schematic view showing the surface potentials of the photosensitive drum 1 at respective positions during the target value setting control in this embodiment.

The surface potential of the photosensitive drum 1 at the position immediately before the charging portion of the first charging roller 2A is 0 V (position (A) in FIG. 5). Further, during the target setting control, the charging DC bias application to the first charging roller 2A is turned off. For that reason, the surface potential of the photosensitive drum 1 is not changed even when the photosensitive drum 1 passes through the charging portion of the first charging roller 2A (position (B) in FIG. 5).

Incidentally, in this embodiment, the charging DC bias applied to the first charging roller 2A in the target value setting control is turned off but may also be set at a value such that the surface potential of the photosensitive drum 1 is not changed before and after passing through the charging portion of the first charging roller 2A. That is, the charging DC bias may only be required that it can provide a value of the DC current, passing through the first charging roller 2A, which is close to zero to the possible extent. In other words, the current passing through the first charging roller 2A is about 0 μA. Further, the control is effected so that the current passing through the first charging roller 2A falls within a predetermined range includes 0 μA (within about 0±5 μA).

Further, the charging AC bias applied to the second charging roller 2B may only be required that the peak-to-peak voltage (Vpp) is not less than 2 times the discharge start voltage Vth in the DC charging type. In such a condition, the surface potential 1 after the photosensitive drum surface passes through the charging portion of the second charging roller 2B converges to the same potential as the charging DC bias applied to at the second charging roller 2B.

FIG. 6 is a graph showing a relationship between the charging DC voltage applied to the second charging roller 2B and the surface potential of the photosensitive drum 1 in the case where the photosensitive drum 1 is charged in the DC charging type in the environment of the temperature of 23° C. and the humidity of 50% RH. As shown in FIG. 6, in this embodiment, the discharge start voltage Vth is about 600 V. Therefore, in this embodiment, the peak-to-peak voltage of the charging AC bias applied to the second charging roller 2B may be not less than 1200 Vpp which is 2 times the discharge start voltage Vth.

As described above, in this embodiment, the peak-to-peak voltage of the charging AC bias applied to the second charging roller 2B in the target value setting control is 1500 Vpp. For that reason, the surface potential of the photosensitive drum 1 after passing through the charging portion of the second charging roller 2B is −500 V (position (C) in FIG. 5).

Thereafter, the photosensitive drum surface reaches the developing portion c with the rotation of the photosensitive drum 1 while keeping the surface potential of the photosensitive drum 1 at −500 V. The potential difference between the surface potential (−500 V) of the photosensitive drum 1 and the developing DC bias (−350 V) is small and therefore the surface potential of the photosensitive drum 1 is not changed and is −500 V (position (D) in FIG. 5) even after passing through the developing portion c.

Thereafter, the photosensitive drum surface reaches the transfer portion d with the rotation of the photosensitive drum 1 while keeping the surface potential of the photosensitive drum 1 at −500 V. By the electric discharge based on the potential difference between the surface potential (−500 V) of the photosensitive drum 1 and the transfer bias (+600 V), the surface potential of the photosensitive drum 1 is 0 V (position (E) in FIG. 5), so that the photosensitive drum surface reaches again the charging portion of the second charging roller 2B.

Here, a relationship between the surface potential of the photosensitive drum 1 and the value of the DC current passing between the second charging roller 2B and the photosensitive drum 1 before and after the photosensitive drum surface passes through the charging portion of the second charging roller 2B will be described.

FIG. 7 is a graph showing a relationship between the peak-to-peak voltage of the charging AC bias applied to the second charging roller 2B and the surface potential of the photosensitive drum 1 after passing through the charging portion of the second charging roller 2B under the above-described target value setting control condition (except for the charging AC bias). When the peak-to-peak voltage of the charging AC bias is 1200 Vpp or more, it is understood that the surface potential of the photosensitive drum 1 is constant at −500 V which is the same as the charging DC bias.

FIG. 8 is a graph showing a relationship between the peak-to-peak voltage of the charging AC bias applied to the second charging roller 2B and the value of the current passing between the second charging roller 2B and the photosensitive drum 1 under the above-described target value setting control condition (except for the charging AC bias). When the peak-to-peak voltage of the charging AC bias is 1200 Vpp or more, it is understood that the value of current passing between the second charging roller 2B and the photosensitive drum 1 is constant.

That is, in the target value setting control, when the peak-to-peak voltage of the charging AC bias is 1200 Vpp or more, the value of the DC current passing through the second charging roller 2B is as follows. That is, it becomes the DC current value necessary to change the surface potential (0 V) of the photosensitive drum 1, at the position immediately before the photosensitive drum surface reaches the charging portion of the second charging roller 2B, to −500 V (target potential Vd) which is the same as the charging DC bias applied to the second charging roller 2B. Therefore, this DC current value is a target DC current value Idc, for the value of the DC current carried by the charging in the DC charging type, necessary to change the surface potential of the photosensitive drum 1 before the charging in the AC charging type to the target potential Vd (i.e., necessary to increase the absolute value of the surface potential up to the target potential Vd). In this embodiment, the target DC current value actually measured by the second measuring circuit 13B under the above target value setting control condition was −35 μA.

In this embodiment, the control circuit 14 measures, before the image formation is effected, the value of the current passing through the second charging roller 2B by the second measuring circuit 13B in the target value setting control and stores the measured value as the target DC current value Idc in a memory 14*a* as a storing means incorporated in the control circuit 14.

Further, in this embodiment, the control circuit 14 determines, in the target value setting control before the image formation is effected, the charging DC bias applied to the first charging roller 2A necessary to obtain the stored target DC current value Idc (−35 μA in this embodiment). In this embodiment, the value of the DC current passing through the first charging roller 2A is measured by the measuring circuit 13B while the charging DC bias applied to the first charging roller 2A is changed by the control circuit 14. Then, the charging DC bias, applied to the first charging roller 2A, necessary to obtain the target DC current value Idc is determined. The control circuit 14 stores the determined bias as a target voltage value in the memory 14*a*. In this embodiment, the charging DC bias, applied to the first charging roller 2A, necessary to obtain the target DC current value Idc was calculated as −1100 V.

Next, control of the charge voltage during the image formation will be described. During the image formation, to the first charging roller 2A, the charging DC bias obtained by the above-described target value setting control is applied. This will be described below more specifically.

In this embodiment, various bias settings during the image formation are as follows. The charging DC bias applied to the first charging roller 2A is −1100 V. Further, to the second charging roller 2B, the charging DC bias of −500 V and the peak-to-peak voltage of 1250 Vpp of the charging AC bias are applied. The developing DC bias is −350 V. The transfer bias is +600 V. Further, these bias settings are kept constant during the image formation. Here, the peak-to-peak voltage charging AC bias applied to the second charging roller 2B is somewhat larger than 1200 Vpp which is the discharge start voltage, so that an AC discharge current amount is about 10 μA.

Incidentally, in the target value setting control, the peak-to-peak voltage of the charging AC bias applied to the second charging roller 2B is 1500 Vpp. As a result, the occurrence of the abnormal electric discharge is prevented in the target value setting control, so that the target DC current value Idc can be obtained with high accuracy. That is, in this embodiment, the peak-to-peak voltage of the charging AC bias applied to the second charging roller 2B during the target value setting control is larger than that during the image formation.

FIG. 9 is a schematic view showing the surface potentials of the photosensitive drum 1 at respective positions during the target value setting control in this embodiment.

The surface potential of the photosensitive drum 1 at the position immediately before the charging portion of the first charging roller 2A is 0 V (position (A) in FIG. 9) similarly as during the target value setting control. Further, during the image formation, to the first charging roller 2A, the charging DC bias (−1100 V in this embodiment) determined in the above-described target value setting control is applied. Therefore, the current with the DC current value (target DC current value Idc) necessary to change the surface potential of the photosensitive drum 1 before the charging in the AC charging type to the target potential Vd. For that reason, the surface potential of the photosensitive drum 1 after passing through the charging portion of the first charging roller 2A is −500 V (position (B) in FIG. 9).

Further, to the second charging roller 2B, the charging DC bias of −500 V and the charging AC bias of 1200 Vpp or more in peak-to-peak voltage are applied. For that reason, the surface potential of the photosensitive drum 1 after passing through the charging portion of the second charging roller 2B converges to −500 V (position (C) in FIG. 9). That is, the surface potential of the photosensitive drum 1 before and after passing through the charging portion of the second charging roller 2B is not changed.

Thereafter, the change in surface potential of the photosensitive drum 1 at positions (D) and (E) are substantially identical to those during the above-described target value setting control (FIG. 5).

5. Flow Chart

FIG. 10 is a flow chart showing an example of execution control of the target value setting control. As described above, in this embodiment, the target value setting control is executed in the pre-rotation step. The target value setting control may be executed in every pre-rotation step or in every predetermined period such that the image formation on a predetermined number of sheets is effected. For example, as shown in FIG. 10, the control circuit 14 discriminates, when an image formation start signal is inputted (S101), whether or not that time is timing when the target value setting control is to be executed (S102). In the case where the control circuit 14 discriminates that the time is the target value setting timing in S102, the control circuit 14 executes the target value setting control in the pre-rotation step (S103) and then executes the image forming process (S104). In the image forming process, the charging DC bias applied to the first charging roller 2A is determined in immediately-before target value setting control and is controlled at the value stored in the memory 14*a*. On the other hand, in the case where the control circuit 14 discriminates that the time is not the target value setting timing in S102, the control circuit 14 executes the target value setting control in the pre-rotation step in which the target value setting control is not executed (S105) and then executes the image forming process (S104). In the image forming process, the charging DC bias applied to the first charging roller 2A is determined in the latest target value setting control and is controlled at the value stored in the memory 14*a*.

FIG. 11 is a flow chart of the target value setting control in this embodiment. The control circuit 14 turns off the charging DC bias applied to the first charging roller 2A when the target value setting control is started. Further, the charging DC bias applied to the second charging roller 2B is set at the target potential Vd, and the charging AC bias is set at the value of the condition in which the electric discharge occurs. Then, the image forming apparatus 100 is actuated without forming the image (S201). Then, the control circuit 14 stores, as the target DC current value Idc in the memory 14*a*, the value of the DC current passing through the second charging roller 2B measured by the second measuring circuit 13B when the image forming apparatus 100 is in operation under the bias setting described above (S202). Next, the control circuit 14 determines the charging DC bias, applied to the first charging roller 2A, necessary to obtain the target DC current value Idc and then stores the determined value in the memory 14*a* (S203). During the image formation, the charging DC bias applied to the first charging roller 2A is subjected to constant-voltage control at the stored charging DC bias value.

Incidentally, in this embodiment, the target value setting control was effected in the pre-rotation step as during the non-image formation. However, the present invention is not limited thereto but the target value setting control may also be effected during another non-image formation such as in the pre-multi-rotation step, in the sheet interval step or in the post-rotation step. Further, e.g., the target value setting control may also be executed in a plurality of the above non-image formation periods of the steps such as the pre-multi-rotation step, the pre-rotation step, the sheet interval step and post-rotation step. Further, the target value setting control can also be carried out as interrupt control during a job (a series of image forming operations with respect to a single or plurality of transfer materials on the basis of a single image formation start signal) every predetermined period such as a period in which the image formation on a predetermined number of sheets is effected.

As described above, the image forming apparatus 100 includes the photosensitive drum 1 on which the electrostatic image is formed, the first charging member 2A for charging the surface of the moving photosensitive drum 1, the second charging member 2B for charging the surface of the photosensitive drum 1 at the position downstream of the charging portion of the first charging member 2A with respect to the surface movement direction of the photosensitive drum 1, the exposure means 3 for forming the electrostatic image on the photosensitive drum 1 by exposing to light the photosensitive drum 1 charged to a predetermined charge potential, the first power source S1A for applying the DC voltage to the first charging member 2A, the second power source S1B for applying to the second charging member 2B the oscillating voltage in the form of the DC voltage biased with the AC voltage, and the control means 14 for controlling the first power source S1A and the second power source S1B. The control means 14 controls the first power source S1A so that the DC voltage for changing the surface potential of the photosensitive drum 1 reaching the charging portion of the surface of the photosensitive drum 1 by the second charging member 2B to the above-described predetermined charge potential to the possible extent is applied to the first charging member 2A. At the same time, during the image formation, the control means 14 controls the second power source S1B so that the oscillating voltage in the form of the DC voltage corresponding to the predetermined charge potential biased with the AC voltage for causing the electric discharge between the photosensitive drum 1 and the second charging member 2B is applied to the second charging member 2B.

Particularly, in this embodiment, the image forming apparatus 100 includes the first detecting means 13A for detecting the value of the DC current passing through the first charging member 2A when the DC voltage is applied from the first power source S1A to the first charging member 2A and includes the second detecting means 13B for detecting the value of the DC current passing through the second charging member 2B when the oscillating voltage is applied from the second power source S1B to the second charging member 2B. The control means 14 effects the following target value setting control before the image formation. That is, in the target value setting control, the control means 14 controls the first power source S1A so that the value of the DC current passing through the first charging member 2A is made zero to the possible extent. At the same time, the control means 14 controls the second power source S1B so that the oscillating voltage in the form of the DC voltage corresponding to the predetermined charge potential biased with the AC voltage for causing the electric discharge between the photosensitive drum 1 and the second charging member 2B is applied to the second charging member 2B. At that time, the value of the DC current passing through the second charging member 2B is detected by the second detecting means 13B. At the same time, the output voltage value of the first power source S1A when the DC voltage is applied from the first power source S1A to the first charging member 2A so that the value of the DC current corresponding to the detected value of the DC current is detected by the first detecting means 13A is obtained as the target voltage value. Then, during the image formation, the control means 14 controls the DC voltage applied from the power source S1A to the first charging member 2A so that it becomes the target voltage value.

6. Effect

By carrying out the target value setting control and the control of the charging DC bias applied to the first charging roller 2A during the image formation in this embodiment, the following effects can be obtained.

During the image formation, the first charging roller 2A charges the photosensitive drum 1 in the DC charging type. For that reason, the sandy image is not generated even when the surface potential of the photosensitive drum 1 before and after passing through the charging portion of the first charging roller 2A is changed. However, in the DC charging type, there is no leveling effect of the AC discharge current and therefore a stripe-like improper charging due to minute non-uniformity of the electric resistance value of the first charging roller 2A is liable to occur. On the other hand, during the image formation, the surface potential of the photosensitive drum 1 is not changed before and after the photosensitive drum surface passes through the charging portion of the second charging roller 2B. For that reason, as described above, in such a condition, the sandy image is not most readily generated. Therefore, even when the AC discharge current amount is minimized, the sandy image is not generated. As a method for minimizing the AC discharge current amount, it is possible to employ known electric discharge current control or the like. In this embodiment, the image formation was effected by using the peak-to-peak voltage of 1250 Vpp of the charging AC bias applied to the second charging roller 2B so that the AC discharge current amount was 10 μA. By minimizing the AC discharge current amount, it is possible to remarkably alleviate the deterioration of the photosensitive drum 1 and the occurrence of the image flow. Further, the leveling effect by the AC discharge current can be obtained and therefore uniform charging (discharging) can be made, so that image-quality improvement can be achieved. Further, in this embodiment, the surface of the photosensitive drum 1 is charged by applying the DC voltage to the upstream first charging roller 2A with respect to the movement direction of the photosensitive drum 1 and by applying the oscillating voltage in the form of the DC voltage biased with the AC voltage to the downstream second charging roller 2B with respect to the movement direction. According to such a constitution, even in the case where the image forming apparatus 100 is increased in speed and thus the surface movement speed of the photosensitive drum 1 is relatively high, the charge potential of the photosensitive drum 1 can be stabilized.

Incidentally, in this embodiment, such a condition that the surface potential of the photosensitive drum 1 before and after passing through the charging portion of the second charging roller 2B is not changed and the DC current does not pass through the second charging roller 2B was employed during the image formation. In order to more effectively prevent the sandy image, the value of the DC current passing through the second charging roller 2B during the image formation may preferably be close to zero to the possible extent. However, the value of the DC current passing through the second charging roller 2B during the image formation is not limited to zero. Depending on the setting of the charging AC bias (i.e., the AC discharge current amount) and a required sandy image-preventing effect, the value of the DC current passing through the second charging roller 2B during the image formation can be made smaller than the value of the DC current passing through the first charging roller 2A during the image formation. For example, when the value of the DC current passing through the second charging roller 2B during the image formation is about 80% to 100% of the value of the DC current passing through the first charging roller 2A during the image formation, it is possible to obtain the sandy image-preventing effect as desired. That is, e.g., when the absolute value of the surface potential of the photosensitive drum 1 can be increased up to 80% to 100% of the target potential Vd, it is possible to obtain the preventing effect of the sandy image generated due to the abnormal electric discharge of the second charging roller 2B, as desired.

As described above, according to this embodiment, during the image formation, the charging DC bias on the basis of the target DC current value Idc obtained in the target value setting control is applied to the first charging roller 2A, so that the absolute value of the surface potential of the photosensitive member 1 is increased up to the target potential Vd. Further, to the second charging roller 2B, the oscillating voltage in the form of the charging DC bias superposed with the charging AC bias is applied. As a result, it is possible to suppress the occurrence of the sandy image while achieving the image-quality improvement. That is, the sandy image is not readily generated and therefore the AC discharge current amount can be minimized, so that the deterioration of the photosensitive member 1 and the image flow can be suppressed. Thus, according to this embodiment, even in the case where the AC discharge current amount is reduced as small as possible, it is possible to suppress the occurrence of the image defect, such as the sandpaper-like image defect, due to the abnormal electric discharge.

Embodiment 2

Embodiment 2 of the present invention will be described. Basic constitution and operation of an image forming apparatus in this embodiment are the same as those in Embodiment 1. Therefore, elements (members) having the same functions and constitutions as those in Embodiment 1 are represented by the same reference numerals or symbols and will be omitted from detailed description.

In this embodiment, the charging DC bias applied to the first charging roller 2A during the image formation is outputted by so-called constant-current control so that the value of the DC current passing through the first charging roller 2A measured by the first measuring circuit 13A is equal to the target DC current value Idc. In this embodiment, the first power source S1A is capable of outputting not only the voltage in the constant-current control but also the voltage, which is subjected to the constant-current control by using a software, by changing the output voltage value so that the DC current value measured by the first measuring circuit 13A is a predetermined value.

FIG. 12 is a flow chart showing an example of execution control of the target value setting control in this embodiment. In this embodiment, the execution control (S301 to S305) of the target value setting control can be the same as that (S101 to S105) described in Embodiment 1 with reference to FIG. 10. However, in the image forming process, the charging bias applied to the first charging roller 2A is subjected to the constant current control so that the value of the current passing through the first charging roller 2A is determined in the latest or immediately-before target value setting control and is equal to the target DC current value Idc stored in the memory 14*a*.

FIG. 13 is a flow chart of the target value setting control in this embodiment. The target value setting control in this embodiment is the same as that in Embodiment 1 until the target DC current value Idc is obtained and set. The control circuit 14 turns off the charging DC bias applied to the first charging roller 2A when the target value setting control is started. Further, the charging DC bias applied to the second charging roller 2B is set at the target potential Vd, and the charging AC bias is set at the value of the condition in which the electric discharge occurs. Then, the image forming apparatus 100 is actuated without forming the image (S401). Then, the control circuit 14 stores, as the target DC current value Idc in the memory 14*a*, the value of the DC current passing through the second charging roller 2B measured by the second measuring circuit 13B when the image forming apparatus 100 is in operation under the bias setting described above (S402). During the image formation, the charging DC bias applied to the first charging roller 2A is subjected to the constant-current control so that the value of the DC current passing through the first charging roller measured by the first measuring circuit 13A is equal to the target DC current value Idc.

Further, the charge voltage control during the image formation is the same as that in Embodiment 1 except that the charging DC bias applied to the first charging roller 2A is subjected to the constant-current control so that the value of the current passing through the first charging roller 2A is equal to the target DC current value Idc.

Thus, in this embodiment, the image forming apparatus 100 includes the first detecting means 13A for detecting the value of the DC current passing through the first charging member 2A when the DC voltage is applied from the first power source S1A to the first charging member 2A and includes the second detecting means 13B for detecting the value of the DC current passing through the second charging member 2B when the oscillating voltage is applied from the second power source S1B to the second charging member 2B. The control means 14 effects the following target value setting control before the image formation. That is, in the target value setting control, the control means 14 controls the first power source S1A so that the value of the DC current passing through the first charging member 2A is made zero to the possible extent. At the same time, the control means 14 controls the second power source S1B so that the oscillating voltage in the form of the DC voltage corresponding to the predetermined charge potential of the photosensitive member 1 biased with the AC voltage for causing the electric discharge between the photosensitive member 1 and the second charging member 2B is applied to the second charging member 2B. At that time, the value of the DC current passing through the second charging member 2B is detected as the target DC current value by the second detecting means 13B. Then, during the image formation, the control means 14 controls the DC voltage applied from the power source S1A to the first charging member 2A so that the value of the DC current detected by the first detecting means 13A becomes the target DC current value.

According to this embodiment, effects similar to those in Embodiment 1 can be obtained.

Embodiment 3

Embodiment 3 of the present invention will be described. Basic constitution and operation of an image forming apparatus in this embodiment are the same as those in Embodiment 1. Therefore, elements (members) having the same functions and constitutions as those in Embodiment 1 are represented by the same reference numerals or symbols and will be omitted from detailed description.

In Embodiment 1, the case where the surface potential (residual potential) of the photosensitive drum 1 immediately before reaching the charging portion of the first charging roller 2A was described. However, in some cases, the residual potential varies depending on the respective high-voltage source bias settings, operation environment, operation history, and the type of the developer used in the image forming apparatus 100.

Therefore, in this embodiment, the case where the residual potential is not 0 V. Incidentally, the control in this embodiment is effected in the environment of the temperature of 23° C. and the relative humidity of 50% RH.

First, similarly as in Embodiment 1, before the image formation is effected, the following target value setting control is effected to obtain the target DC current value Idc.

In this embodiment, various bias settings during the target value setting control are as follows. The charging DC bias applied to the first charging roller 2A is −200 V. Further, to the second charging roller 2B, the charging DC bias of −500 V and the peak-to-peak voltage of 1500 Vpp of the charging AC bias are applied. The developing DC bias is −350 V. The transfer bias is +400 V. Further, these bias settings are kept constant and then the image forming apparatus 100 is operated without forming an image. In this case, operation settings of respective portions of the image forming apparatus, such as the various bias settings, are the same as those during the image formation except for the charging DC bias applied to the first charging roller 2A and the charging AC bias applied to the second charging roller 2B.

FIG. 14 is a schematic view showing the surface potentials of the photosensitive drum 1 at respective positions during the target value setting control in this embodiment.

The surface potential (residual potential) of the photosensitive drum 1 at the position immediately before the charging portion of the first charging roller 2A is −200 V (position (A) in FIG. 14). Further, during the target setting control, the charging DC bias of −200 V is applied to the first charging roller 2A. For that reason, the surface potential of the photosensitive drum 1 is not changed even when the photosensitive drum 1 passes through the charging portion of the first charging roller 2A (position (B) in FIG. 14).

Incidentally, in this embodiment, the charging DC bias applied to the first charging roller 2A in the target value setting control is −200 V but may also be set at a value such that the surface potential of the photosensitive drum 1 is not changed before and after passing through the charging portion of the first charging roller 2A. That is, the charging DC bias may only be required that it can provide a value of the DC current, passing through the first charging roller 2A, which is close to zero to the possible extent.

Further, in the target value setting control, the charging AC bias applied to the second charging roller 2B may only be required that the peak-to-peak voltage (Vpp) is not less than 2 times the discharge start voltage Vth in the DC charging type. That is, similarly as in Embodiment 1, the charging AC bias may be not less than 1200 Vpp which is 2 times the discharge start voltage Vth. In such a condition, the surface potential 1 after the photosensitive drum surface passes through the charging portion of the second charging roller 2B converges to the same potential as the charging DC bias applied to at the second charging roller 2B.

As described above, in this embodiment, the peak-to-peak voltage of the charging AC bias applied to the second charging roller 2B in the target value setting control is 1500 Vpp. For that reason, the surface potential of the photosensitive drum 1 after passing through the charging portion of the second charging roller 2B is −500 V (position (C) in FIG. 14).

Thereafter, the photosensitive drum surface reaches the developing portion c with the rotation of the photosensitive drum 1 while keeping the surface potential of the photosensitive drum 1 at −500 V. The potential difference between the surface potential (−500 V) of the photosensitive drum 1 and the developing DC bias (−350 V) is small and therefore the surface potential of the photosensitive drum 1 is not changed and is −500 V (position (D) in FIG. 14) even after passing through the developing portion c.

Thereafter, the photosensitive drum surface reaches the transfer portion d with the rotation of the photosensitive drum 1 while keeping the surface potential of the photosensitive drum 1 at −500 V. By the electric discharge based on the potential difference between the surface potential (−500 V) of the photosensitive drum 1 and the transfer bias (+400 V), the surface potential of the photosensitive drum 1 is −200 V (position (E) in FIG. 14), so that the photosensitive drum surface reaches again the charging portion of the second charging roller 2B.

Similarly as in Embodiment 1, when the peak-to-peak voltage of the charging AC bias is 1200 Vpp or more, the value of the DC current passing through the second charging roller 2B is as follows. That is, it becomes the DC current value necessary to change the surface potential (−200 V) of the photosensitive drum 1, at the position immediately before the photosensitive drum surface reaches the charging portion of the second charging roller 2B, to −500 V (target potential Vd) which is the same as the charging DC bias applied to the second charging roller 2B. Therefore, this DC current value is a target DC current value Idc, for the value of the DC current carried by the charging in the DC charging type, necessary to change the surface potential of the photosensitive drum 1 before the charging in the AC charging type to the target potential Vd (i.e., necessary to increase the absolute value of the surface potential up to the target potential Vd). In this embodiment, the target DC current value actually measured by the second measuring circuit 13B under the above target value setting control condition was −21 μA.

In this embodiment, the control circuit 14 measures, before the image formation is effected, the value of the current passing through the second charging roller 2B by the second measuring circuit 13B in the target value setting control and stores the measured value as the target DC current value Idc in a memory 14*a* as a storing means incorporated in the control circuit 14.

Further, in this embodiment, the control circuit 14 determines, in the target value setting control before the image formation is effected, the charging DC bias applied to the first charging roller 2A necessary to obtain the stored target DC current value Idc (−21 μA in this embodiment). In this embodiment, the value of the DC current passing through the first charging roller 2A Is measured by the measuring circuit 13B while the charging DC bias applied to the first charging roller 2A is changed by the control circuit 14. Then, the charging DC bias, applied to the first charging roller 2A, necessary to obtain the target DC current value Idc is determined. In this embodiment, the charging DC bias, applied to the first charging roller 2A, necessary to obtain the target DC current value Idc was calculated as −1100 V.

Next, control of the charge voltage during the image formation will be described. During the image formation, to the first charging roller 2A, the charging DC bias obtained by the above-described target value setting control is applied. This will be described below more specifically.

In this embodiment, various bias settings during the image formation are as follows. The charging DC bias applied to the first charging roller 2A is −1100 V. Further, to the second charging roller 2B, the charging DC bias of −500 V and the peak-to-peak voltage of 1250 Vpp of the charging AC bias are applied. The developing DC bias is −350 V. The transfer bias is +400 V. Further, these bias settings are kept constant during the image formation. Here, the peak-to-peak voltage charging AC bias applied to the second charging roller 2B is somewhat larger than 1200 Vpp which is the discharge start voltage, so that an AC discharge current amount is about 10 μA.

FIG. 15 is a schematic view showing the surface potentials of the photosensitive drum 1 at respective positions during the target value setting control in this embodiment.

The surface potential of the photosensitive drum 1 at the position immediately before the charging portion of the first charging roller 2A is −200 V (position (A) in FIG. 14) similarly as during the target value setting control. Further, during the image formation, to the first charging roller 2A, the charging DC bias (−1100 V in this embodiment) determined in the above-described target value setting control is applied. Therefore, the current with the DC current value (target DC current value Idc) necessary to change the surface potential of the photosensitive drum 1 before the charging in the AC charging type to the target potential Vd. For that reason, the surface potential of the photosensitive drum 1 after passing through the charging portion of the first charging roller 2A is −500 V (position (B) in FIG. 15).

Further, to the second charging roller 2B, the charging DC bias of −500 V and the charging AC bias of 1200 Vpp or more in peak-to-peak voltage are applied. For that reason, the surface potential of the photosensitive drum 1 after passing through the charging portion of the second charging roller 2B converges to −500 V (position (C) in FIG. 15). That is, the surface potential of the photosensitive drum 1 before and after passing through the charging portion of the second charging roller 2B is not changed.

Thereafter, the change in surface potential of the photosensitive drum 1 at positions (D) and (E) are substantially identical to those during the above-described target value setting control (FIG. 14).

According to this embodiment, even in the case where the residual potential is not 0 V, the same effects as in Embodiment 1 can be obtained.

Incidentally, in this embodiment, similarly as in Embodiment 1, in the target value setting control, the target DC current value Idc was obtained, and the charging DC bias, applied to the first charging roller 2A, providing the target DC current value Idc passing through the first charging roller 2A was obtained. However, the constitution in Embodiment 2 may also be employed. That is, without calculating the charging DC bias, the charging DC bias applied to the first charging roller 2A may also be outputted in so-called constant-current control so that the value of the DC current passing through the first charging roller 2A measured by the first measuring circuit 13A is equal to the target DC current value Idc. Also in this case, similar effects

Embodiment 4

Embodiment 4 of the present invention will be described. In an image forming apparatus in this embodiment, elements (members) having the same functions and constitutions as those in Embodiment 1 are represented by the same reference numerals or symbols and will be omitted from detailed description.

2. Control Embodiment

Parts (a) and (b) of FIG. 16 are black circuit diagrams of the charging voltage applying systems with respect to the first charging roller 2A and the second charging roller 2B, respectively in this embodiment.

As shown in (a) of FIG. 16, to the first charging roller 2A, the first charging power source S1A as the charging voltage applying means is connected. This first charging power source S1A includes a DC power source 11A. From the first charging power source S1A, the charging DC bias is applied to the first charging roller 2A through the core metal 21A. As a result, the peripheral surface of the rotating photosensitive drum 1 is charged to the predetermined potential. Incidentally, in this embodiment, the first measuring circuit 13A provided in Embodiment 1 ((a) of FIG. 4) is not provided. control means, information on the measured DC current value is inputted.

On the other hand, as shown in (b) of FIG. 16, to the second charging roller 2AB, the second charging power source S1B as the charging voltage applying means is connected. This second charging power source S1B includes a DC power source 11B and an AC power source 12B. From the first charging power source S1B, a predetermined oscillating voltage in the form of the charging DC bias biased with the charging AC bias with a predetermined frequency is applied to the second charging roller 2B through the core metal 21B. As a result, the peripheral surface of the rotating photosensitive drum 1 is charged to the predetermined potential. Further, to the second charging power source S1B, a DC current value measuring circuit (measuring circuit) 13 as a DC current value detecting means (detecting means) is connected. The measuring circuit 13 detects the value of the DC current passing through the second charging roller 2B via the photosensitive drum 1 by outputting the oscillating voltage from the second charging power source S1B to the second charging roller 2B. From the measuring circuit 13 to the control circuit 14 as a control means, information on the measured DC current value is inputted.

The control circuit 14 as the control means effects integrated control of the operation of the image forming apparatus 100. Particularly, in a relation to this embodiment, the control circuit 14 has the function of controlling the value of the DC voltage applied from the DC power source 11A of the first charging power source S1A to the first charging roller 2A. Further, the control circuit 14 has the function of controlling the value of the DC voltage applied from the DC power source 11B of the second charging power source S1B to the second charging roller 2B. Further, the control circuit 14 has the function of controlling the value of the peak-to-peak voltage of the AC voltage applied to or the value of the AC current passing through the second charging roller 2B form the AC power source 12B of the second charging power source S1B. Further, the control circuit 14 has the function of executing, on the basis of the DC current value information inputted from the measuring circuit 13, the operation/determination program of the charging DC bias applied to the first charging roller 2A and/or the second charging roller 2B in the charging step of the image forming process.

3. Charge Voltage Control

Next, a control method of the charge voltage applied to the first and second charging rollers 2A and 2B during the image formation will be described specifically. Incidentally, the control in this embodiment is effected in an environment of a temperature of 23° C. and a humidity (relative humidity) of 50% RH.

As described above, in the AC charging type, when the photosensitive drum surface potential before the charging and the charging DC bias potential are the same, the abnormal electric discharge is not most readily caused to occur, so that the degree of the occurrence of the sandy image is most reduced.

Therefore, in this embodiment, the value of the DC current passing through the second charging roller 2B is measured by the measuring circuit 13 during the image formation. Then, the charging DC bias applied to the first charging roller 2A during the image formation is controlled so that the measured DC current value is equal to a predetermined value (zero in this embodiment). As a result, the value of the DC current passing through the first charging roller 2A during the image formation is used as the following value. That is, the value is used as a value of the DC current, flowing in the charging in the DC charging type, necessary to change the surface potential of the photosensitive drum 1 before the charging in the AC charging type to the target potential Vd (necessary to increase the absolute value of the photosensitive drum surface potential up to the target potential Vd). This will be described below more specifically.

First, in order to explain a principle of the control in this embodiment, the case where the image forming apparatus 100 is operated under the following bias settings during the non-image formation. That is, to the second charging roller 2B, the charging DC bias of −500 V and the peak-to-peak voltage of 1500 Vpp of the charging AC bias are applied. The developing DC bias is −350 V. The transfer bias is +600 V. Further, these bias settings are kept constant and then the image forming apparatus 100 is operated without forming an image. Further, the charging DC bias applied to the first charging roller 2A is outputted by the so-called constant-current control s that the value of the DC current passing through the second charging roller 2B measured by the measuring circuit 13 is 0 μA. In this embodiment, the first charging power source S1A is capable of outputting not only the voltage by the constant-current control but also the voltage subjected to the constant-current control using a software by changing an output voltage value so that the value of the DC current measured by the measuring circuit 13 is the predetermined value. In this case, operation settings of respective portions of the image forming apparatus, such as the various bias settings in the above operation, are the same as those during the image formation except for the charging DC bias applied to the first charging roller 2A and the charging AC bias applied to the second charging roller 2B.

FIG. 17 is a schematic view showing the surface potentials of the photosensitive drum 1 at respective positions when the image forming apparatus 100 is operated in the above bias settings.

The surface potential of the photosensitive drum 1 at the position immediately before the charging portion of the first charging roller 2A is 0 V (position (A) in FIG. 17). Further, the charging DC bias applied to the first charging roller 2A is outputted by the constant current control so that the value of the current passing through the second charging roller 2B measured by the measuring circuit 13 is 0 μA. For that reason, as described later, the surface potential of the photosensitive drum 1 after the photosensitive drum 1 passes through the charging portion of the first charging roller 2A becomes −500 V (position (B) in FIG. 17).

Further, the charging AC bias applied to the second charging roller 2B may only be required that the peak-to-peak voltage (Vpp) is not less than 2 times the discharge start voltage Vth in the DC charging type. In such a condition, the surface potential 1 after passing through the second charging roller 2B converges to the same potential as the charging DC bias applied to at the second charging roller 2B.

Similarly as in Embodiment 1, in this embodiment, the peak-to-peak voltage of the charging AC bias applied to the second charging roller 2B may be not less than 1200 Vpp which is 2 times the discharge start voltage Vth (FIGS. 6 to 8).

As described above, in the case where the peak-to-peak voltage of the charging AC bias applied to the second charging roller 2B in the target value setting control is 1500 Vpp, the surface potential of the photosensitive drum 1 after passing through the charging portion of the second charging roller 2B becomes −500 V (position (c) in FIG. 17).

Here, the fact that the value of the DC current passing through the second charging roller 2B measured by the measuring circuit 13 is 0 μA means that the surface potential of the photosensitive drum 1 is not changed before and after the photosensitive drum surface passes through the charging portion of the second charging roller 2B. From this, it is understood that the surface potential of the photosensitive drum 1 after passing through the charging portion of the first charging roller 2A is −500 V (position (B) in FIG. 17). That is, it is understood that the surface potential of the photosensitive drum 1 passing through the charging portion of the first charging roller 2A is changed from 0 V (position (A) in FIG. 17) to −500 V (position (B) in FIG. 17).

Thereafter, the photosensitive drum surface reaches the developing portion c with the rotation of the photosensitive drum 1 while keeping the surface potential of the photosensitive drum 1 at −500 V. The potential difference between the surface potential (−500 V) of the photosensitive drum 1 and the developing DC bias (−350 V) is small and therefore the surface potential of the photosensitive drum 1 is not changed and is −500 V (position (D) in FIG. 17) even after passing through the developing portion c.

Thereafter, the photosensitive drum surface reaches the transfer portion d with the rotation of the photosensitive drum 1 while keeping the surface potential of the photosensitive drum 1 at −500 V. By the electric discharge based on the potential difference between the surface potential (−500 V) of the photosensitive drum 1 and the transfer bias (+600 V), the surface potential of the photosensitive drum 1 is 0 V (position (E) in FIG. 17), so that the photosensitive drum surface reaches again the charging portion of the second charging roller 2B.

By applying the charging DC bias to the first charging roller 2A while effecting the control as described above, the surface potential of the photosensitive drum 1 after passing through the charging portion of the first charging roller 2A can be made equal to the target potential Vd.

In order to explain the principle of the constitution in this embodiment, the above-described control was effected by operating the image forming apparatus 100 with no image formation. In actuality, the control as described above (charging DC bias control) is effected during the image formation in the image forming process.

In this embodiment, in the case where the charging DC bias control is actually effected during the image formation, various bias settings are as follows.

To the second charging roller 2B, the charging DC bias of −500 V and the peak-to-peak voltage of 1250 Vpp of the charging AC bias are applied. The developing DC bias is −350 V. The transfer bias is +600 V. Further, these bias settings are kept constant during the image formation. Further, the charging DC bias applied to the first charging roller 2A is outputted by the so-called constant current control so that the value of the DC current passing through the second charging roller 2B measured by the measuring circuit 13 is 0 μA. Here, the peak-to-peak voltage charging AC bias applied to the second charging roller 2B is somewhat larger than 1200 Vpp which is the discharge start voltage, so that an AC discharge current amount is about 10 μA.

The surface potentials of the photosensitive drum 1 at the respective positions in the case where such charging DC bias control is effected during the image formation are the same as those shown in FIG. 17. That is, the charging AC bias applied to the second charging roller 2B is different from that in the example used for explaining the principle of the constitution in this embodiment but such a point that the AC discharge is effected by applying the charging AC bias having the peak-to-peak voltage of 1200 Vpp or more is not changed. For that reason, the surface potentials of the photosensitive drum 1 at the respective positions during the image formation are the same as those shown in FIG. 17.

4. Flow Chart

FIG. 18 is a flow chart of the charging DC bias control effected during the image formation in this embodiment.

The control circuit 14 starts the charging operation when it discriminates that the time is charge voltage application timing (S501). That is, the charging DC bias is applied to the first charging roller 2A, and the charging DC bias of the target potential Vd and the charging AC bias causing the electric discharge are applied to the second charging roller 2B (S502). At this time, the charging DC bias is, e.g., a preset initial value. Then, the control circuit 14 measures, under the above condition, the value of the DC current Idc passing through the second charging roller 2B by the measuring circuit 13 (S503). In the case where the measured DC current value Idc is not 0 V, the control circuit 14 changes the charging DC bias applied to the first charging roller 2A to adjust the charging DC bias so that the measured DC current value Idc becomes 0 μA (S504). This adjustment of the charging DC bias is continued during an application period of the charge voltage during the image formation (S505, S506).

Thus, in this embodiment, the image forming apparatus 100 includes a detecting means 13 for detecting the value of the DC current passing through the second charging member 2B when the oscillating voltage is applied from the second power source S1B to the second charging member 2B. Then, during the image formation, the control means 14 controls the DC voltage applied from the power source S1A to the first charging member 2A so that the DC current value detected by the detecting means 13 is made zero to the possible extent.

5. Effect

By carrying out the control of the charging DC bias applied to the first charging roller 2A during the image formation in this embodiment, the following effects can be obtained.

During the image formation, the first charging roller 2A charges the photosensitive drum 1 in the DC charging type. For that reason, the sandy image is not generated even when the surface potential of the photosensitive drum 1 before and after passing through the charging portion of the first charging roller 2A is changed. However, in the DC charging type, there is no leveling effect of the AC discharge current and therefore a stripe-like improper charging due to minute non-uniformity of the electric resistance value of the first charging roller 2A is liable to occur. On the other hand, during the image formation, the surface potential of the photosensitive drum 1 is not changed before and after the photosensitive drum surface passes through the charging portion of the second charging roller 2B. For that reason, as described above, in such a condition, the sandy image is not most readily generated. Therefore, even when the AC discharge current amount is minimized, the sandy image is not generated. As a method for minimizing the AC discharge current amount, it is possible to employ known electric discharge current control or the like. In this embodiment, the image formation was effected by using the peak-to-peak voltage of 1250 Vpp of the charging AC bias applied to the second charging roller 2B so that the AC discharge current amount was 10 μA. By minimizing the AC discharge current amount, it is possible to remarkably alleviate the deterioration of the photosensitive drum 1 and the occurrence of the image flow. Further, the leveling effect by the AC discharge current can be obtained and therefore uniform charging (discharging) can be made, so that image-quality improvement can be achieved. Further, in this embodiment, the surface of the photosensitive drum 1 is charged by applying the DC voltage to the upstream first charging roller 2A with respect to the movement direction of the photosensitive drum 1 and by applying the oscillating voltage in the form of the DC voltage biased with the AC voltage to the downstream second charging roller 2B with respect to the movement direction. According to such a constitution, even in the case where the image forming apparatus 100 is increased in speed and thus the surface movement speed of the photosensitive drum 1 is relatively high, the charge potential of the photosensitive drum 1 can be stabilized.

Further, in this embodiment, during the image formation, depending on the measurement result of the measuring circuit 13, the charging DC bias applied to the first charging roller 2A can be appropriately adjusted. For that reason, a time required for control for setting the target value in, e.g., the pre-rotation step is not needed, so that the constitution in this embodiment is advantageous in terms of productivity of the image.

Incidentally, in this embodiment, such a condition that the surface potential of the photosensitive drum 1 before and after passing through the charging portion of the second charging roller 2B is not changed and the DC current does not pass through the second charging roller 2B was employed during the image formation. In order to more effectively prevent the sandy image, the value of the DC current passing through the second charging roller 2B during the image formation may preferably be close to zero to the possible extent. However, the value of the DC current passing through the second charging roller 2B during the image formation is not limited to zero. Depending on the setting of the charging AC bias (i.e., the AC discharge current amount) and a required sandy image-preventing effect, the value of the DC current passing through the second charging roller 2B during the image formation can be made smaller than the value of the DC current passing through the first charging roller 2A during the image formation. For example, when the value of the DC current passing through the second charging roller 2B during the image formation is about 80% to 100% of the value of the DC current passing through the first charging roller 2A during the image formation, it is possible to obtain the sandy image-preventing effect as desired. That is, e.g., when the absolute value of the surface potential of the photosensitive drum 1 can be increased up to 80% to 100% of the target potential Vd, it is possible to obtain the preventing effect of the sandy image generated due to the abnormal electric discharge of the second charging roller 2B, as desired.

As described above, according to this embodiment, the value of the DC current passing through the second charging roller 2B while applying, to the second charging roller 2B, the oscillating voltage in the form of the charging DC bias superposed with the charging AC bias. Further, the charging DC bias is applied to the first charging roller 2A so that the measured DC current value becomes 0 μA, whereby the absolute value of the surface potential of the photosensitive drum 1 is increased up to the target potential Vd. As a result, it is possible to suppress the occurrence of the sandy image while achieving the image-quality improvement. That is, the sandy image is not readily generated and therefore the AC discharge current amount can be minimized, so that the deterioration of the photosensitive drum 1 and the image flow can be suppressed. Further, according to this embodiment, the charging DC bias applied to the first charging roller 2A during the image formation is adjusted, so that the time required for control for determining the control target value in, e.g., the pre-rotation step is not needed. For that reason, the constitution in this embodiment is more advantageous in terms of the image productivity. Thus, according to this embodiment, even in the case where the AC discharge current amount is reduced as small as possible, it is possible to suppress the occurrence of the image defect, such as the sandpaper-like image defect, due to the abnormal electric discharge.

Embodiment 5

Embodiment 5 of the present invention will be described. This embodiment is a modified embodiment of Embodiment 4. Basic constitution and operation of an image forming apparatus in this embodiment are the same as those in Embodiment 1. Therefore, elements (members) having the same functions and constitutions as those in Embodiment 1 are represented by the same reference numerals or symbols and will be omitted from detailed description.

In Embodiment 4, during the image formation, the charging DC bias applied to the first charging roller 2A was adjusted. In this embodiment, the same control as that in Embodiment 4 can be effected.

The same control as that described with reference to FIG. 17 in Embodiment 4 can be effected, as the target value setting control similarly as in Embodiment 1, with the following timing. That is the control can be effected, during, e.g., a job (a series of image forming operations on a single or plurality of transfer materials on the basis of a single image formation start signal), as interrupt control in every predetermined period such as every image formation on a predetermined number of sheets.

FIG. 19 is a flow chart in the case where the same control as that in Embodiment 4 is effected as the target value setting control. Here, this target value setting control is effected as the interrupt control every image formation on N sheets during the job.

The control circuit 14 starts the charging operation when the target value setting control is started after the image formation on the N-th sheet is ended during the job. That is, the charging DC bias is applied to the first charging roller 2A, and the charging DC bias of the target potential Vd and the charging AC bias causing the electric discharge are applied to the second charging roller 2B (S601). At this time, the charging DC bias is, e.g., a preset initial value. Then, the control circuit 14 measures, under the above condition, the value of the DC current Idc passing through the second charging roller 2B by the measuring circuit 13 (S602). When the measured DC current value Idc is not 0 μA, the control circuit 14 changes the charging DC bias applied to the first charging roller 2A to adjust the charging DC bias so that the measured DC current value Idc becomes 0 μA. Then, the control circuit 14 stores, as the control target value during the image formation, the charging DC bias applied to the first charging roller 2A so that the measured DC current value Idc becomes 0 μA, in the memory 14*a* incorporated therein as the starting means (S603). Thereafter, the control circuit 14 effects the image formation on (N+1)-th sheet by using the determined charging DC bias.

Incidentally, in this embodiment, the target value setting control was effected as the interrupt control in a period between jobs as the non-image formation period. However, the non-image formation period is not limited thereto but may also be other periods of non-image formation such as the pre-multi-rotation step, the pre-rotation step, the sheet interval step and the post-rotation step. Further, the target value setting control may also be executed in a plurality of the non-image formation periods described above.

In this embodiment, during the target value setting control, the peak-to-peak voltage of the charging AC bias applied to the second charging roller 2B is 1500 Vpp. Further, during the image formation, the peak-to-peak voltage of the charging AC bias applied to the second charging roller 2B is changed to 1250 Vpp so that the AC discharge current amount is 10 μA.

Thus, in this embodiment, the image forming apparatus 100 includes a detecting means 13 for detecting the value of the DC current passing through the second charging member 2B when the oscillating voltage is applied from the second power source S1B to the second charging member 2B. Further, the control circuit 4 effects the following target value setting control before the image formation. That is, in the target value setting control, the control circuit 14 controls the DC voltage applied from the first power source S1A to the first charging member 2A so that the value of the DC current detected by the detecting means 13 is made zero to the possible extent. At the same time, the control circuit 14 controls the second power source S1B so that the oscillating voltage in the form of the DC voltage corresponding to the predetermined charge potential of the photosensitive drum 1 superposed with the AC voltage causing the electric discharge between the photosensitive drum 1 and the second charging member 2B is applied to the second charging member 2B. Then, an output voltage value of the first power source S1A at that time is obtained as the target voltage value. Then, during the image formation, the control circuit 14 controls the DC voltage applied from the first power source S1A to the first charging member 2A so as to become the target voltage value described above.

As in this embodiment, the same control as that in Embodiment 4 can also be effected as the target value setting control during the non-image formation.

Embodiment 6

Embodiment 6 of the present invention will be described. This embodiment is a modified embodiment of Embodiment 4. Basic constitution and operation of an image forming apparatus in this embodiment are the same as those in Embodiment 1. Therefore, elements (members) having the same functions and constitutions as those in Embodiment 1 are represented by the same reference numerals or symbols and will be omitted from detailed description.

In Embodiment 4, the case where the surface potential (residual potential) of the photosensitive drum 1 immediately before reaching the charging portion of the first charging roller 2A was described. However, in some cases, the residual potential varies depending on the respective high-voltage source bias settings, operation environment, operation history, and the type of the developer used in the image forming apparatus 100.

Therefore, in this embodiment, the case where the residual potential is not 0 V. Incidentally, the control in this embodiment is effected in the environment of the temperature of 23° C. and the relative humidity of 50% RH.

First, in order to explain a principle of control in this embodiment, the case where the image forming apparatus 100 is operated during the non-image formation with the following bias settings as described below. That is, to the second charging roller 2B, the charging DC bias of −500 V and the peak-to-peak voltage of 1500 Vpp of the charging AC bias are applied. The developing DC bias is −350 V. The transfer bias is +400 V. Further, these bias settings are kept constant and then the image forming apparatus 100 is operated without forming an image. Further, the charging DC bias applied to the first charging roller 2A is outputted by the so-called constant-current control s that the value of the DC current passing through the second charging roller 2B measured by the measuring circuit 13 is 0 μA. In this embodiment, the first charging power source S1A is capable of outputting not only the voltage by the constant-current control but also the voltage subjected to the constant-current control using a software by changing an output voltage value so that the value of the DC current measured by the measuring circuit 13 is the predetermined value. In this case, operation settings of respective portions of the image forming apparatus, such as the various bias settings in the above operation, are the same as those during the image formation except for the charging DC bias applied to the first charging roller 2A and the charging AC bias applied to the second charging roller 2B.

FIG. 20 is a schematic view showing the surface potentials of the photosensitive drum 1 at respective positions when the image forming apparatus 100 is operated in the above bias settings.

The surface potential of the photosensitive drum 1 at the position immediately before the charging portion of the first charging roller 2A is −200 V (position (A) in FIG. 20). Further, the charging DC bias applied to the first charging roller 2A is outputted by the constant current control so that the value of the current passing through the second charging roller 2B measured by the measuring circuit 13 is 0 μA. For that reason, as described later, the surface potential of the photosensitive drum 1 after the photosensitive drum 1 passes through the charging portion of the first charging roller 2A becomes −500 V (position (B) in FIG. 20).

Further, the charging AC bias applied to the second charging roller 2B may only be required that the peak-to-peak voltage (Vpp) is not less than 2 times the discharge start voltage Vth in the DC charging type. That is, similarly as in Embodiment 4, the charging AC bias may be not less than 1200 Vpp which is 2 times the discharge start voltage Vth. In such a condition, the surface potential 1 after passing through the charging portion of the second charging roller 2B converges to the same potential as the charging DC bias applied to at the second charging roller 2B.

As described above, in the case where the peak-to-peak voltage of the charging AC bias applied to the second charging roller 2B in the target value setting control is 1500 Vpp, the surface potential of the photosensitive drum 1 after passing through the charging portion of the second charging roller 2B becomes −500 V (position (c) in FIG. 20).

Here, the fact that the value of the DC current passing through the second charging roller 2B measured by the measuring circuit 13 is 0 μA means that the surface potential of the photosensitive drum 1 is not changed before and after the photosensitive drum surface passes through the charging portion of the second charging roller 2B. From this, it is understood that the surface potential of the photosensitive drum 1 after passing through the charging portion of the first charging roller 2A is −500 V (position (B) in FIG. 20). That is, it is understood that the surface potential of the photosensitive drum 1 passing through the charging portion of the first charging roller 2A is changed from 0 V (position (A) in FIG. 20) to −500 V (position (B) in FIG. 20).

Thereafter, the photosensitive drum surface reaches the developing portion c with the rotation of the photosensitive drum 1 while keeping the surface potential of the photosensitive drum 1 at −500 V. The potential difference between the surface potential (−500 V) of the photosensitive drum 1 and the developing DC bias (−350 V) is small and therefore the surface potential of the photosensitive drum 1 is not changed and is −500 V (position (D) in FIG. 20) even after passing through the developing portion c.

Thereafter, the photosensitive drum surface reaches the transfer portion d with the rotation of the photosensitive drum 1 while keeping the surface potential of the photosensitive drum 1 at −500 V. By the electric discharge based on the potential difference between the surface potential (−500 V) of the photosensitive drum 1 and the transfer bias (+400 V), the surface potential of the photosensitive drum 1 is −200 V (position (E) in FIG. 20), so that the photosensitive drum surface reaches again the charging portion of the second charging roller 2B.

By applying the charging DC bias to the first charging roller 2A while effecting the control as described above, the surface potential of the photosensitive drum 1 after passing through the charging portion of the first charging roller 2A can be made equal to the target potential Vd.

In order to explain the principle of the constitution in this embodiment, the above-described control was effected by operating the image forming apparatus 100 with no image formation. In actuality, the control as described above (charging DC bias control) is effected during the image formation in the image forming process.

In this embodiment, in the case where the charging DC bias control is actually effected during the image formation, various bias settings are as follows.

To the second charging roller 2B, the charging DC bias of −500 V and the peak-to-peak voltage of 1250 Vpp of the charging AC bias are applied. The developing DC bias is −350 V. The transfer bias is +600 V. Further, these bias settings are kept constant during the image formation. Further, the charging DC bias applied to the first charging roller 2A is outputted by the so-called constant current control so that the value of the DC current passing through the second charging roller 2B measured by the measuring circuit 13 is 0 μA. Here, the peak-to-peak voltage charging AC bias applied to the second charging roller 2B is somewhat larger than 1200 Vpp which is the discharge start voltage, so that an AC discharge current amount is about 10 μA.

The surface potentials of the photosensitive drum 1 at the respective positions in the case where such charging DC bias control is effected during the image formation are the same as those shown in FIG. 20. That is, the charging AC bias applied to the second charging roller 2B is different from that in the example used for explaining the principle of the constitution in this embodiment but such a point that the AC discharge is effected by applying the charging AC bias having the peak-to-peak voltage of 1200 Vpp or more is not changed. For that reason, the surface potentials of the photosensitive drum 1 at the respective positions during the image formation are the same as those shown in FIG. 20.

According to this embodiment, even in the case where the residual potential is not 0 V, the same effect as that in Embodiment 4 can be obtained.

Other Embodiments

In the above-described embodiments, the constitution in which the residual potential after the transfer is not particularly treated but reaches the charging portion of the first charging roller as it is, is employed. However, e.g., a pre-exposure device is provided as a charge-removing means, between the transfer portion and the charging portion of the first charging roller with respect to the photosensitive drum surface movement direction and the residual potential may be cancelled to provide the potential of 0V. According to such a constitution, the residual potential can be controlled uniformly and therefore the charge-removing device is effective in stably effecting the control in this embodiment. Further, at the image forming portion and non-image forming portion of the photosensitive drum, it is possible to suppress a degree of an occurrence of ghost due to a difference in residual charge amount.

Further, in the above-described embodiments, the example of the image forming apparatus using the cleaning device as the transfer residual toner removing means was described. On the other hand, an image forming apparatus of a cleaner-less type in which a charge optimizing means for the transfer residual toner is provided and the transfer residual toner is collected simultaneously with development by the developing device has been known. The present invention is also applicable to such an image forming apparatus of the cleaner-less type.

Further, in the above-described embodiments, the image forming apparatus had the constitution in which the toner image was directly transferred from the photosensitive drum onto the transfer material. On the other hand, an image forming apparatus of an intermediary transfer type in which the toner image is transferred from the photosensitive drum onto an intermediary transfer member for temporarily holding and carrying the toner image and then is transferred from the intermediary transfer member onto the transfer material has been known. The present invention is also applicable to such an image forming apparatus of the intermediary transfer type.

Further, with respect to the photosensitive drum in each of the above-described embodiments, a charge injection layer having a surface resistance of $10^9$–$10^{14}\Omega$ may also be provided as to assume a direct charge injection property. Even in the case where the charge injection layer is not used, it is possible to obtain a similar effect also, e.g., when the charge transporting layer has the surface resistance falling within the above-described range.

Further, as the photosensitive drums in the above-described embodiments, an amorphous silicon photosensitive member including the surface layer having the volume resistivity of about $10^{13}$ Ω·cm may also be used.

In the above-described respective embodiments, the constitution in which the charging roller is used as a flexible contact charging member is employed but as another flexible contact charging member, it is possible to use those having a shape or material such as a fur brush, a felt, and cloth.

Further, by combining various materials, those having more proper elasticity, electroconductivity, surface property, and durability can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 096577/2011 filed Apr. 22, 2011, which is hereby incorporated by reference.

What is claimed is:

1. An image forming apparatus comprising:

a rotatable photosensitive member;

a first charging member for electrically charging said photosensitive member at a first charging portion by applying thereto a first DC voltage;

a second charging member, provided downstream of the first charging portion with respect to a rotational direction of said photosensitive member, for electrically charging said photosensitive member charged by said first charging member, at a second charging portion by applying thereto an oscillating voltage in the form of a second DC voltage superposed with an AC voltage;

a toner image forming portion, provided downstream of the second charging portion and upstream of the first charging portion with respect to the rotational direction of said photosensitive member, for forming a toner image on a surface of said photosensitive member electrically charged by said first and second charging members;

a current detecting device for detecting a DC current passing through said second charging member; and a controller for controlling a voltage value of the first DC voltage on the basis of the DC current detected by said current detection device when the first DC voltage is applied to said first charging member and the oscillating voltage is applied to said second charging member, wherein said controller controls the voltage value of the first DC voltage so that an absolute value of the DC current detected by said current detecting portion is smaller than a predetermined value.

2. An image forming apparatus comprising:

a rotatable photosensitive member;

a first charging member for electrically charging said photosensitive member at a first charging portion by applying thereto a first DC voltage;

a second charging member, provided downstream of the first charging portion with respect to a rotational direction of said photosensitive member, for electrically charging said photosensitive member, charged by said first charging member, at a second charging portion by applying thereto an oscillating voltage in the form of a second DC voltage superposed with an AC voltage;

a toner image forming portion, provided downstream of the second charging portion and upstream of the first charging portion with respect to the rotational direction of said photosensitive member, for forming a toner image on a surface of said photosensitive member electrically charged by said first and second charging members;

a first current detecting portion for detecting a DC current passing through said first charging member;

a second current detecting portion for detecting a DC current passing through said second charging member;

a controller for controlling a voltage value of the first DC voltage on the basis of a current value detected by said second current detecting portion during execution of an operation in which said photosensitive member is charged by applying the oscillating voltage to said second charging member without charging said photosensitive member by said first charging member and on the basis of a current value detected by said first current detecting portion by applying the first DC voltage to said first charging member, wherein said controller controls the voltage value of the first DC voltage so that the current value detected by said first current detecting portion when said photosensitive member is charged by applying the first DC voltage to said first charging member is substantially equal to the current value detected by said second current detecting portion during execution of the operation.

* * * * *